US009444147B2

(12) United States Patent
Zaghloul et al.

(10) Patent No.: US 9,444,147 B2
(45) Date of Patent: Sep. 13, 2016

(54) ULTRA-WIDE-BAND (UWB) ANTENNA ASSEMBLY WITH AT LEAST ONE DIRECTOR AND ELECTROMAGNETIC REFLECTIVE SUBASSEMBLY AND METHOD

(71) Applicant: U.S. Army Research Laboratory ATTN: RDRL-LOC-I, Adelphi, MD (US)

(72) Inventors: Amir Ibrahim Zaghloul, Bethesda, MD (US); Youn Moo Lee, Clifton, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 212 days.

(21) Appl. No.: 14/018,661

(22) Filed: Sep. 5, 2013

(65) Prior Publication Data

US 2014/0043197 A1 Feb. 13, 2014

Related U.S. Application Data

(63) Continuation-in-part of application No. 13/848,380, filed on Mar. 21, 2013, and a continuation-in-part of application No. 13/713,030, filed on Dec. 13, 2012, application No. 14/018,661, which is a (Continued)

(51) Int. Cl.
*H01Q 19/10* (2006.01)
*H01Q 5/25* (2015.01)

(Continued)

(52) U.S. Cl.
CPC ..... *H01Q 19/10* (2013.01); *H01Q 5/25* (2015.01); *H01Q 9/30* (2013.01); *H01Q 15/008* (2013.01); *H01Q 19/005* (2013.01); *Y10T 29/49016* (2015.01)

(58) Field of Classification Search
CPC ..... H01Q 19/10; H01Q 15/008; H01Q 5/35; H01Q 9/30
See application file for complete search history.

(56) References Cited

U.S. PATENT DOCUMENTS 5,828,340 A * 10/1998 Johnson ..... 343/700 MS
5,874,919 A 2/1999 Rawnick et al.

(Continued)

OTHER PUBLICATIONS

U.S. Appl. No. 12/383,080 entitled "Multi-Element Patch Antenna and Method" by Michael Josypenko, filed Mar. 13, 2009, DTIC online, PDF Url : ADD020441, Report Date : Mar. 13, 2010.

(Continued)

*Primary Examiner* — Sue A Purvis
*Assistant Examiner* — Amal Patel
(74) *Attorney, Agent, or Firm* — Lawrence E. Anderson

(57) ABSTRACT

An ultra-wideband antenna assembly comprising:

an electromagnetic reflective structure for reflecting electromagnetic waves; the electromagnetic reflective structure operating to reflect electromagnetic waves in a first direction;

an antenna operatively associated with the electromagnetic reflective structure such that electromagnetic waves emitted from the antenna towards the electromagnetic wave reflective structure are reflected back by the electromagnetic reflective structure in the first direction; the antenna being substantially planar and extending in a first plane; the first direction being substantially perpendicular to the first plane; and at least one director operatively associated with the antenna for focusing the electromagnetic waves transmitted by the antenna in the first direction; the at least one director being substantially planar and extending in a second plane wherein the second plane is substantially parallel to the first plane.

9 Claims, 22 Drawing Sheets

Related U.S. Application Data continuation-in-part of application No. 13/184,692, filed on Jul. 18, 2011.

(60) Provisional application No. 61/601,584, filed on Feb. 22, 2012.

(51) Int. Cl.

| | |
|---|---|
| ***H01Q 9/30*** | (2006.01) |
| ***H01Q 19/00*** | (2006.01) |
| ***H01Q 15/00*** | (2006.01) |

(56) References Cited

U.S. PATENT DOCUMENTS 6,885,342 B2 * 4/2005 Saegrov et al. ..... 343/700 MS
6,919,862 B2 * 7/2005 Hacker et al. ..... 343/909

OTHER PUBLICATIONS

Simons, R. "Suspended Rectangular/Circular Patch Antennas With Electromagnetically Coupled Inverted Microstrip Feed for Dualpolarization/Frequency," IEEE Explore, Antennas and Propagation Society International Symposium, 2000. IEEE (vol. 4 ) Date of Conference: Jul. 16-21, 2000, NASA Glenn Research Center, Dynacs Engineering Company,21000 Brookpark Road, Cleveland, Ohio 44135, pp. 2204-2207 (2000).

Fujino, Y. "A New Feeding Method for a Dual-Polarized Patch Antenna With Low Cross-Polarization Ratio," Kashima Space Research Center, Tóquio, Japan (2002).www.ctsystemes.com/zeland/publi/166.pdf.

Sievenpiper, D., et al., "High-impedance frequency selective surface with forbidden frequency band," IEEE Trans. Microwave Theory Tech. ,vol. 47, pp. 2059-2074, Nov. 1999.

Yablonovitch, E. "Photonic band-gap structure," J. Opt. Soc. Amer. B, Opt. Phys., vol. 10, pp. 283-295, (Feb. 1993).

Hernandez, A., "915MHz Circular Polarized Patch Antenna" EE172 Final Project Spring 2011 San Jose State University, www.engr.sjsu.edu/rkwok/projects/CP_antenna_Arfel.pdf.

Sievenpiper, D., "High-impedance Electromagnetic Surfaces," Ph. D. dissertation, Dep. Elect.Eng. Univ. California at Los Angeles, Los Angeles, CA, (1999).

Zaghloul, A.I., et al."A Concept for a Broadband Electromagnetic Band Gap (EBG Structure," Proceedings of the 5th European Conference on Antennas and Propagation (EuCAP), pp. 383-387, Apr. 2011.

* cited by examiner

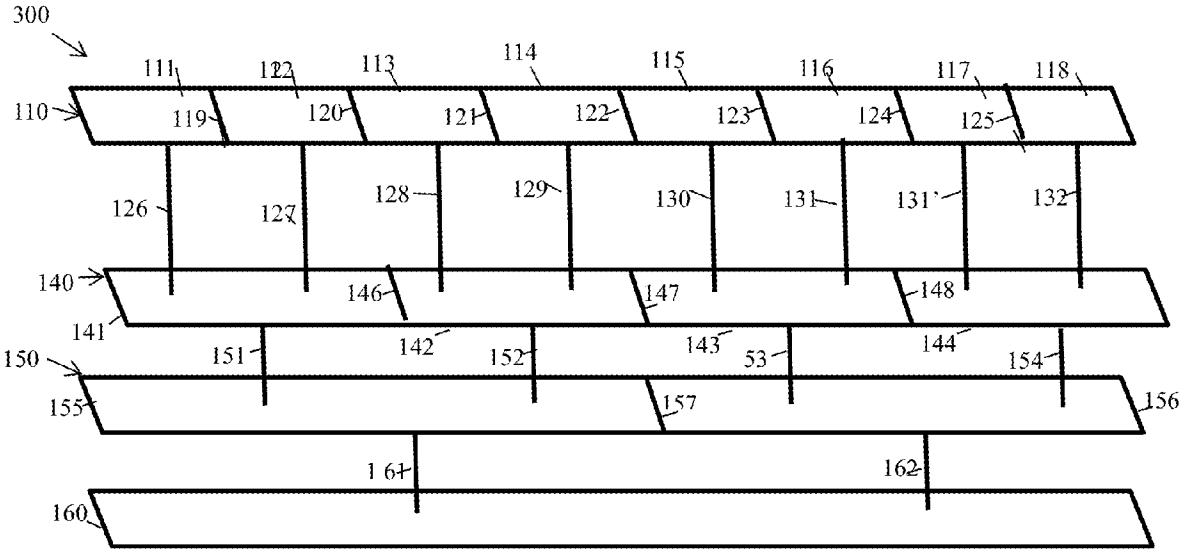
FIG. 4A 3 Layer stacked electronic reflector structure
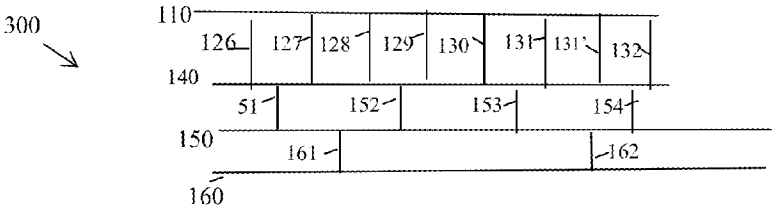
FIG. 4B 3 layer stacked electronic reflector structure side view

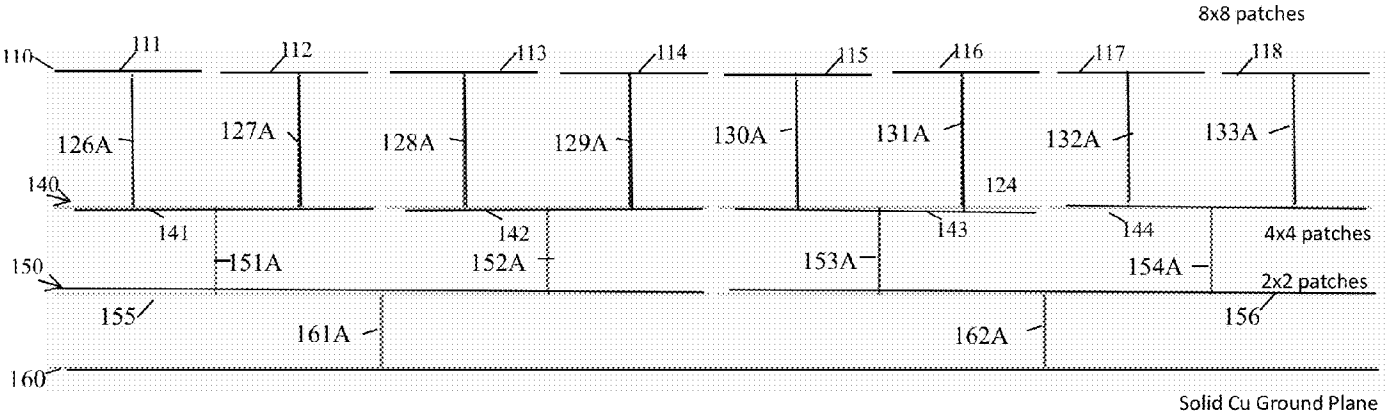
FIG. 6 Side view showing different periodicity in the three layer stacked example
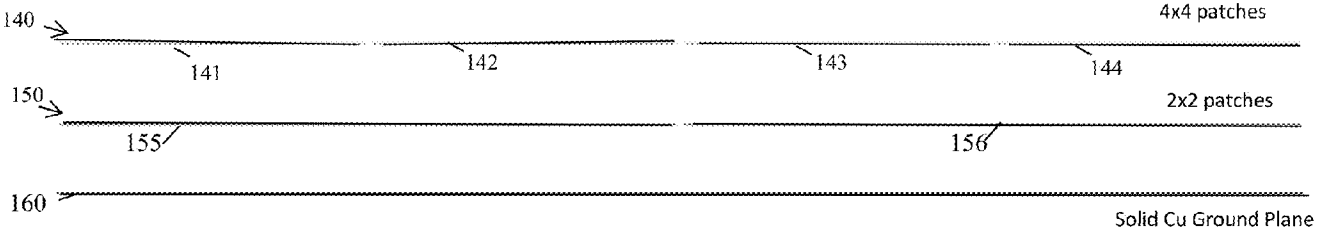
FIG. 7 Side view showing three layer stacked example without vias

FIG. 9 UNIT CELL

Realized gain computed from 700 MHz – 3 GHz.

Computed S11 for an antenna with an electromagnetic reflective structure.

FIG. 14 REALIZED GAIN IS PLOTTED

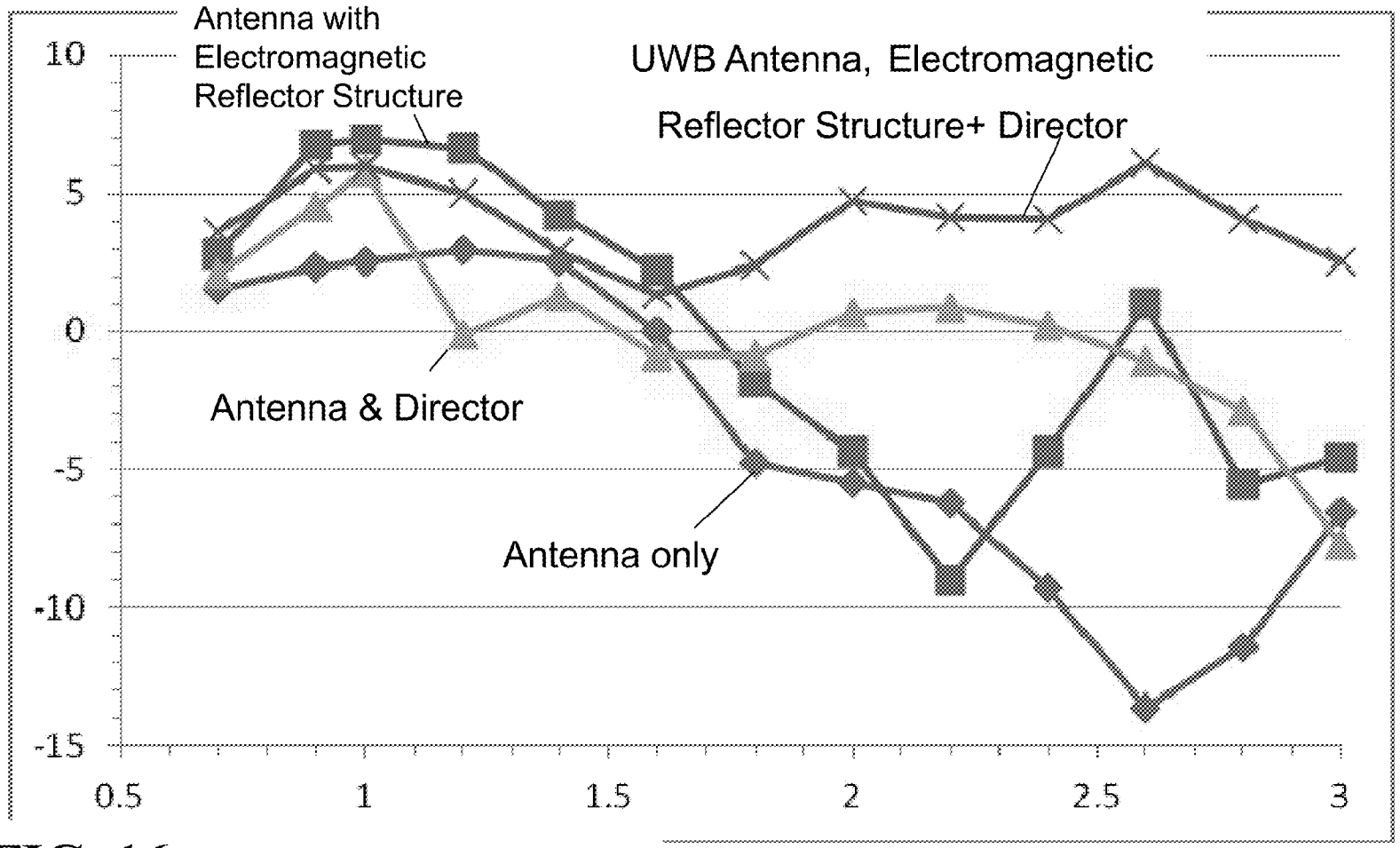
FIG. 16 Realized Gain plot.

ULTRA-WIDE-BAND (UWB) ANTENNA ASSEMBLY WITH AT LEAST ONE DIRECTOR AND ELECTROMAGNETIC REFLECTIVE SUBASSEMBLY AND METHOD

CROSS REFERENCE TO RELATED APPLICATIONS

This application claims priority to U.S. application Ser. No. 13/848,380 entitled "Wideband Electromagnetic Stacked Reflective Surface," by Dr. Amir Ibrahim Zaghloul and Dr. William O'Keefe Coburn filed Mar. 21, 2013 (ARL 12-19), which in turn claims priority to U.S. application Ser. No. 13/713,030 (ARL 11-19) filed Dec. 13, 2012, entitled "A Broadband Electromagnetic Band-Gap (EBG) Structure," by Dr. Amir Zaghloul and Dr. Steven Weiss, which in turn claims the benefit of U.S. Provisional Patent Application No. 61/601,584, filed Feb. 22, 2012. This application also claims priority to U.S. application Ser. No. 13/184692 (ARL 10-03) entitled "Coplanar-Waveguide Fed Monopole Antenna" filed by Youn M. Lee on Jul. 18, 2011. All of the above applications to which priority is claimed are herein incorporated by reference.

STATEMENT OF GOVERNMENT INTEREST

The invention described herein may be manufactured, used, and licensed by or for the United States Government without the payment of royalties.

BACKGROUND OF THE INVENTION

The Yagi-Uda dipole array is a directional antenna consisting of a driven element (usually a dipole or folded dipole) and additional parasitic elements (usually a referred to as a reflector and one or more directors). Also disclosing additional directors is U.S. patent application Ser. No. 12/383080 entitled "Multi-Element Patch Antenna and Method" by Michael Josypenko, filed Mar. 13, 2009, which discloses a driven antenna element mounted on a circuit board with a ground plane formed on the opposite side. At least one parasitic antenna element may be mounted coaxial with and spaced apart from the driven antenna element at an offset distance.

To reduce the radiation to the back-side of the monopole and increase its gain, a reflector layer can be added at the side of the monopole that is opposite to the director side. A conducting ground plane can function as such reflector, but it has to be placed a quarter-wavelength under the monopole in order to produce the right reflection phase. This narrow-band solution also has the disadvantage of increasing the dimension of the antenna in the direction perpendicular to the monopole plane.

By putting a perfect metal conductor behind an antenna, a reflection will occur at −180 degrees phase difference, which leads to cancellation of the radiating waves. Placement of the sheet at one quarter wavelength alleviates this problem but requires a minimum thickness or spacing of $\lambda/4$. However, spacing the antenna at one quarter wavelength of the center frequency so that the reflected wave and the radiated wave constructively combine (along the boresight of the antenna) tends to consume excessive space. Moreover, surface currents or waves may develop in the metal sheet, leading to the propagation of interfering waves of radiation.

In the article entitled "High-Impedance Electromagnetic Surfaces with a Forbidden Frequency Band," IEEE Transactions on Microwave Theory and Techniques," Vol. 47, No. 11, November 1999, pages 2069-2074, herein incorporated by reference, there is described a type of metallic electromagnetic structure that is characterized by having high surface impedance, and although it is made of continuous metal, and conducts dc currents, it does not conduct ac currents within a forbidden frequency band. Unlike normal conductors, the surface does not support propagating surface waves, and its image currents are not phase reversed. The geometry is analogous to a corrugated metal surface in which the corrugations have been folded up into lumped-circuit elements, and distributed in a two-dimensional lattice. The uses include low profile antennas.

The publication by E. Yablonovitch, entitled "Photonic band-gap structure," J. Opt. Soc. Amer. B, Opt. Phys., vol. 10, pp 283-295, (February 1993) describes how a photonic semiconductor can be doped, producing tiny electromagnetic cavities. The article postulates that structures made of positive dielectric-constant materials, such as glasses and insulators, can be arrayed into a three-dimensionally periodic dielectric structure, making a photonic band gap possible, employing a purely real, reactive, dielectric response. The photonic band gap described in the Yablonovitch reference refers to the band gap or an area where electron-hole recombination into photons is inhibited.

Electromagnetic reflective structures are usually periodic consisting of metal patches that are separated by a small gap and vias or pins that connect the patches to the ground plane. The electrical equivalent circuit consists of a resonant tank circuit, whose capacitance is represented by the gap between the patches and the inductance represented by the via. See in this regard D. Sievenpiper, L. Zhang, R. Broas, N. Alexopolous, and E. Yablonovitch, "High-impedance frequency selective surface with forbidden frequency band," IEEE Trans. Microwave Theory Tech., vol. 47, pp 2059-2074, November 1999, and/or D. Sievenpiper, "High-impedance Electromagnetic Surfaces," Ph. D. dissertation, Dep. Elect. Eng. Univ. California at Los Angeles, Los Angeles, Calif., (1999), both of which are hereby incorporated by reference.

The electromagnetic reflective structures are in effect a magnetic surface at the frequency of resonance and thus have very high surface impedance. This makes a tangential current element close to the electronic band gap structure equivalent to two current elements oriented in the same direction without the electronic reflective structure, which helps to enhance the forward radiation instead of completely canceling it, as suggested by the image theory. This makes electronic reflective structures useful when mounting an antenna close to a ground plane, provided the antenna's currents are parallel to the electronic reflective structure. Electronic reflective structures have previously been known to operate over a very narrow band, and thus not useful with a broadband antenna.

SUMMARY OF THE INVENTION

A preferred embodiment of the present invention comprises an ultra-wideband antenna assembly comprising an electromagnetic reflective subassembly or structure for reflecting electromagnetic waves in a first direction; an antenna operatively associated with the electromagnetic reflective structure or subassembly such that electromagnetic waves emitted from the antenna towards the electromagnetic wave reflective subassembly or structure are reflected back by the electromagnetic reflective subassembly or structure in the first direction; the antenna being substantially planar and extending in a first plane; the first direction being substantially perpendicular to the first plane; and at least one director operatively associated with the antenna for focusing the electromagnetic waves transmitted by the antenna in the first direction; the at least one director being substantially planar and extending in a second plane wherein the second plane is substantially parallel to the first plane. Optionally, the electromagnetic reflective subassembly or structure may comprise a plurality of patches extending in a third plane substantially parallel to the first plane. Optionally, the antenna may be supported by a dielectric substrate and may be driven by an electrically conductive coplanar waveguide in electrical communication with the antenna, the electrically conductive coplanar waveguide comprising two ground planes supported by the dielectric substrate. Optionally, the antenna may be a planar circular monopole antenna and the dielectric substrate may be either fiberglass reinforced epoxy laminate (FR-4), polytetrafluoroethylene (PTFE) composites reinforced with glass microfibers, or ceramic, or combinations thereof, and the dielectric substrate may be rectilinear in shape. As a further option, the antenna may be rectilinear, ellipsoidal, pentagonal, hexagonal, or polygon with seven or more sides, or arbitrary in shape, and the ground planes may be rectilinear. Optionally, the preferred embodiment assembly may comprise a plurality of directors, each director may be substantially planar and extend in a plane substantially parallel and spaced-apart planes.

The electromagnetic reflective subassembly or structure may comprise first and second surfaces having spaced patches of conductive material thereon having high impedance and forming substantially optimal magnetic conductors, whereby the electromagnetic reflective subassembly or structure operates to reflect radiated electromagnetic radiation originating from the antenna, the radiation reflected by the electromagnetic reflective subassembly or structure such that the phase of the electromagnetic waves reflected from first and second surfaces (or groups of patches) results in the constructive addition of the originating and reflected waves, thus enhancing the radiation of electromagnetic waves by the antenna. The first and second surfaces (or groups) may be substantially parallel stacked layers, each layer resonating at a different frequency leading to a plurality of resonances (created in the cavities between the first and second surfaces (or groups)) at different frequencies resulting in operation of the antenna at a broadband of frequencies and wherein the plurality of resonances are a function of the spacing between patches of conductive material and the size of the patches.

Optionally, the first and second surfaces (or groups) may be separated by at least one dielectric material comprising one of ceramic, foam and plastic such that the spacing between the first and second surfaces (or groups of patches) forms a resonant cavity. Optionally, the electromagnetic reflective subassembly or structure may comprise at least three layers arranged as top, middle and bottom layers, and the dimensions of the 3 stacked layers may be selected such that the bottom layer resonates at 0.6 GHz, the middle layer resonates at 0.9 GHz, and the top layer resonates at 1.1 GHz. As another example, the electromagnetic reflective subassembly or structure may comprise a first plurality of spaced apart patches of conductive material extending in a third plane substantially parallel to the planes of the antenna; the first plurality of spaced apart patches operating to reflect electromagnetic waves in a first frequency range; a second layer substantially parallel to and separated from the first layer, the second layer being substantially planar and comprising a second plurality of spaced apart patches of conductive material operating to reflect electromagnetic waves in a second frequency range; a third layer substantially parallel to and separated from the first and second layers the third layer being substantially planar and comprising a third plurality of spaced apart patches of conductive material operating to reflect electromagnetic waves in a third frequency range; the first, and third frequency ranges being additive such that the electromagnetic reflective subassembly or structure reflects electromagnetic waves in a ultra wide frequency band. The patches in the respective layers may be of different sizes so as to produce a resonate effect at different ranges of frequency.

Optionally, the electromagnetic reflective subassembly or structure may comprise a base and the first, second and third plurality of patches are supported by a first, second and third plurality of supports, the first supports extending between the first plurality of patches and second plurality of patches, the second supports extending between the second plurality of patches and third plurality of patches, the third supports extending between the third plurality of patches and the base. The first and second plurality of patches may extend in two directions and the regions between may comprise resonant cavities.

The region between the first layer and second layer may comprise a first resonant cavity and the region between the second layer and third layer may comprise a second resonant cavity, the first and second resonant cavities each operating to form first and second resonant tank circuits; the capacitance of the first resonant tank circuit being dependent upon the distance between the first and second plurality of patches, and the capacitance of the second resonant tank circuit being dependent upon the distance between the second and third patches, and wherein the inductance of the first and second resonant tank circuits comprises the electrical characteristics of the first and second supports, respectfully. Optionally, radiation reflected by the electromagnetic reflective subassembly or structure from the antenna is such that the phase of the electromagnetic waves reflected from first, second and third layers areas results in the constructive addition of the originating and reflected waves, thus enhancing the radiation of electromagnetic waves by the antenna. In addition, the first, second and third plurality of patches may be supported by a first, second and third dielectric layers.

A preferred methodology of the present invention is a method of making an ultrawideband antenna comprising: providing an electromagnetic reflective subassembly or structure for reflecting electromagnetic radiation; the electromagnetic wave reflective subassembly or structure operating to reflect waves in a first direction; providing an antenna operatively associated with the electromagnetic reflective subassembly or structure such that waves emitted from the antenna towards the electromagnetic wave reflective subassembly or structure are reflected back by the electromagnetic reflective subassembly or structure towards the antenna; the antenna being substantially planar and extending in a substantially in a first plane; providing at least one director operatively associated with the antenna for focusing the electromagnetic waves transmitted by the antenna; the at least one director being substantially planar and extending in a second plane wherein the second plane is substantially parallel to the first plane, and providing an electrically conductive coplanar waveguide in electrical communication with the antenna, the electrically conductive coplanar waveguide comprising two ground planes supported by a dielectric substrate.

BRIEF DESCRIPTION OF THE DRAWINGS

The foregoing and other objects, features, and advantages of the invention will be apparent from the following more detailed description of the preferred embodiments of the invention, as illustrated in the accompanying drawings, wherein:

FIG. 4A is a schematic illustration of an alternate preferred embodiment multiple layered electromagnetic reflective subassembly 300. The alternate electromagnetic reflective subassembly 300 in substitution for electromagnetic reflective subassembly 30 in conjunction with the embodiments of FIGS. 1A-1C, 2A-2C and 3A.3D FIG. 4B is a side view schematic illustration of the three-layered electromagnetic reflective subassembly 300.

FIG. 6 is a side view showing a electromagnetic reflective subassemby of a preferred embodiment of the present invention with vias.

FIG. 7 is a side view showing a stacked electromagnetic reflective subassemby of a preferred embodiment of the present invention without vias.

F

FIG. 16 is an illustration showing realized gain plot of an ultra-wideband antenna with an electromagnetic reflective structure and a director, Realized gain plot of an ultra-wideband antenna with an electromagnetic reflective structure and a director, the line with x tick marks. It is overlaid with other combinations described previously. The line with diamond tick marks is antenna only, the line with triangle tick marks is antenna with a director, and the line with square tick marks is antenna with electromagnetic reflective structure.

Figure 1A:
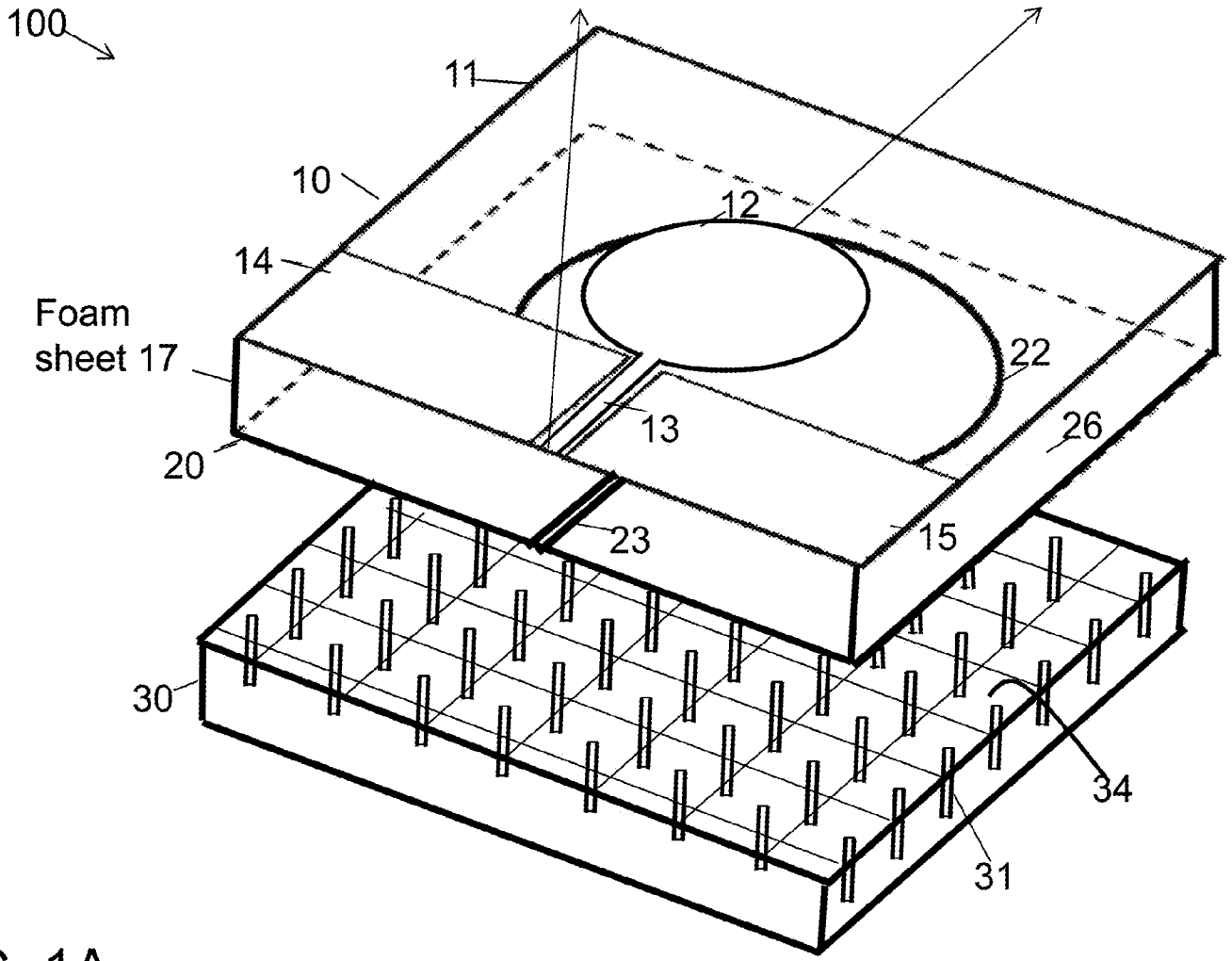
FIG. 1A is a schematic, trimetric illustration of a preferred embodiment antenna, director, and an electromagnetic reflective structure.
Figure 1B:
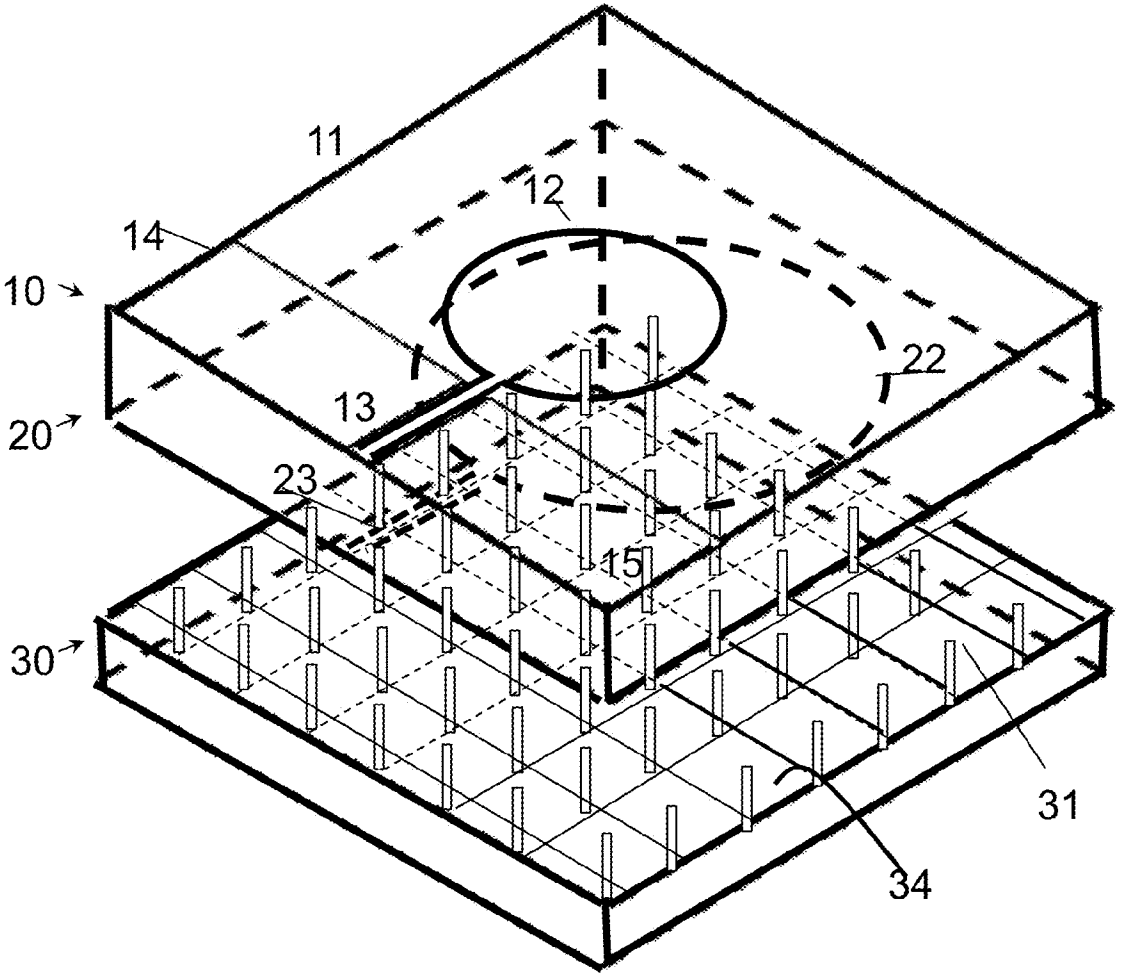
FIG. 1B is a schematic, transparent view of the preferred embodiment antenna, director, and an electromagnetic reflective structure of FIG. 1A.
Figure 1C:
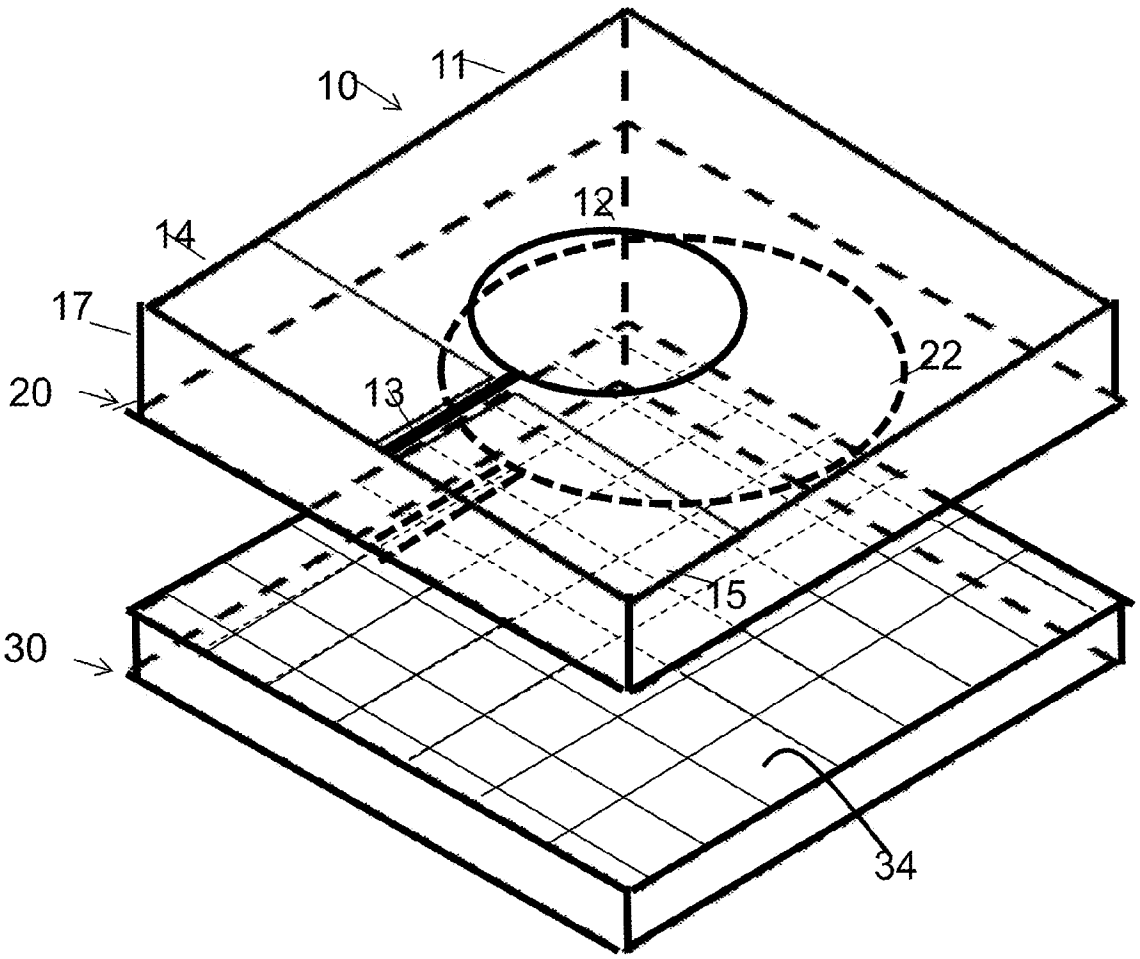
FIG. 1C is a schematic, transparent view of the preferred embodiment antenna, director, and an electromagnetic reflective structure without vias and comprising patches 34.

A more complete appreciation of the invention will be readily obtained by reference to the following Description of the Preferred Embodiments and the accompanying drawings in which like numerals in different figures represent the same structures or elements. The representations in each of the figures are diagrammatic and no attempt is made to indicate actual scales or precise ratios. Proportional relationships are shown as approximates.

DESCRIPTION OF THE PREFERRED EMBODIMENTS

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. The examples used herein are intended merely to facilitate an understanding of ways in which the embodiments of the invention may be practiced and to further enable those of skill in the art to practice the embodiments of the invention. Accordingly, the examples should not be construed as limiting the scope of the embodiments of the invention. Rather, these embodiments are provided so that this disclosure will be thorough and complete, and will fully convey the scope of the invention to those skilled in the art. In the drawings, the dimensions of objects and regions may be exaggerated for clarity. Like numbers refer to like elements throughout. As used herein the term "and/or" includes any and all combinations of one or more of the associated listed items.

The terminology used herein is for the purpose of describing particular embodiments only and is not intended to limit the full scope of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof It will be understood that when an element such as an object, layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms first, second, etc. may be used herein to describe various elements, components, regions, layers and/or sections, these elements, components, regions, layers and/or sections should not be limited by these terms. For example, when referring first and second photons in a photon pair, these terms are only used to distinguish one element, component, region, layer or section from another region, layer or section. Thus, a first element, component, region, layer or section discussed below could be termed a second element, component, region, layer or section without departing from the teachings of the present invention.

Furthermore, relative terms, such as "lower" or "bottom" and "upper" or "top," may be used herein to describe one element's relationship to other elements as illustrated in the Figures. It will be understood that relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below. Furthermore, the term "outer" may be used to refer to a surface and/or layer that is farthest away from a substrate.

Embodiments of the present invention are described herein with reference to cross-section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region or object illustrated as a rectangular will, typically, have tapered, rounded or curved features. Thus, the regions illustrated in the figures are schematic in nature and their shapes are not intended to illustrate the precise shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will also be appreciated by those of skill in the art that references to a structure or feature that is disposed "adjacent" another feature may have portions that overlap or underlie the adjacent feature.

Referring now to U.S. application Ser. No. 13/713,030 (ARL 11-19) filed Dec. 13, 2012, entitled "A Broadband Electromagnetic Band-Gap (EBG) Structure," by Dr. Amir Zaghloul and Dr. Steven Weiss, U.S. patent application Ser. No. 13/713,030 (ARL 11-19), to which priority is being claimed, discloses methods and apparatus for providing a broadband electromagnetic reflective structure, referred to therein as "Electromagnetic Band-Gap (EBG) Structure." Electromagnetic band gap structures are generally passive devices useful in conjunction with antennas that provide a reflective surface "behind" the antenna to allow for phase difference that does not lead to cancellation of the propagating wave. Electromagnetic band gap structures may, for example, be periodic structures that have special properties, such as high surface impedance (which prevent the above-mentioned surface currents). Accordingly, a ground plane having electronic band gap structures formed thereon can act as a near-perfect magnetic conducting structure, and therefore suppress the formation of surface waves. Heretofore, the terminology "band gap" referred to the operation of the device between the stop band, where waves are not propagated and the pass band, where waves are propagated leading to the creation of a "band gap" in the frequency region where waves are propagated. However, the structures being described herein are not limited to a band gap structures per se. Some embodiments include a cascade of differently sized reflective structures, each of which resonates at a different, but closely-spaced frequency. In some embodiments this is accomplished by using concentric patterns of reflective structures, each pattern having a basic cell size that progressively increases the further the cell is positioned from a central point, so as to cause resonances at closely-spaced frequency bands, thereby providing a continuous ultra wideband operational bandwidth for the progressive reflective structure. In some embodiments the concentric cascade of reflective patterns are provided as a single tier structure, and in other embodiments, each pattern is provided on a different tier. In even further embodiments a parallel cascade of reflective patterns is provided. The reflective structure can be designed to operate over a wide band, and because of its reflection phase characteristics, it can be placed close to the monopole plane. This reduces the overall size of the antenna. The combination of a director element in front of the monopole and an EBG reflective surface behind it produce the predicted Yagi-Uda effect of high directive gain across the wide frequency band.

Referring now to U.S. application Ser. No. 13/848,380 entitled "Wideband Electromagnetic Stacked Reflective Surface," by Dr. Amir Ibrahim Zaghloul and Dr. William O'Keefe Coburn filed Mar. 21, 2013 (ARL 12-19), there is disclosed an electromagnetic structure for reflecting electromagnetic waves comprising a first surface having spaced patches of conductive material thereon; a second surface separated from the first surface, having spaced patches of conductive material, the first and second surfaces having high impedance and forming substantially optimal magnetic conductors; the electromagnetic structure adapted to be used in conjunction with an associated antenna that radiates electromagnetic radiation originating therefrom, the radiation is reflected by the electromagnetic structure such that the phase of the electromagnetic waves reflected from first and second surfaces results in the constructive addition of the originating and reflected waves, thus enhancing the radiation of electromagnetic waves by the associated antenna. Each of the first and second surfaces comprise stacked layers resonating at a different frequency leading to a plurality of resonances at different frequencies resulting in operation of the associated antenna at a broadband of frequencies. The multiple resonances being a function of the spacing between patches of conductive material and the size of the patches. The conductive material portions are substantially planar and are substantially parallel to one another; the electromagnetic waves being reflected in the forward direction, away from the first surface. The first and second layers may be separated by at least one dielectric material; wherein the spacing between the first and second layers forms a resonant cavity.

An alternate preferred embodiment comprises an electromagnetic structure for reflecting electromagnetic waves comprising a first planar area comprising a first plurality of spaced apart patches of conductive material; the first plurality of spaced apart patches operating to reflect electromagnetic waves in a first frequency range; a second planar area substantially parallel to and separated from the first planar area, the second planar area comprising a second plurality of spaced apart patches of conductive material operating to reflect electromagnetic waves in a second frequency range; a third planar area substantially parallel to and separated from the first and second planar areas, the third planar area comprising a third plurality of spaced apart patches of conductive material operating to reflect electromagnetic waves in a third frequency range; the first, and third frequency ranges being additive such that the electromagnetic structure reflects electromagnetic waves in a ultra wide frequency band; whereby the electromagnetic structure is adapted to be used in conjunction with an associated antenna that radiates electromagnetic radiation originating therefrom, the radiation being reflected by the electromagnetic structure being such that the phase of the electromagnetic waves reflected from first and second layers results in the constructive addition of the originating and reflected waves, thus enhancing the radiation of electromagnetic waves by the associated antenna.

The alternate preferred embodiment electromagnetic structure may further comprising a base layer which conforms in shape to the object upon which the electromagnetic structure is secured, the object being one of a human body, aircraft and motor vehicle and wherein the range of the ultra wide frequency band exceeds 500 MHZ. The first, second and third plurality of patches may have different sizes so as to produce a resonate effect at different ranges of frequency. The structure may optionally comprise a base and, optionally, the first, second and third plurality of patches may extend in two dimensions, and be supported by a first, second and third plurality of supports, the first supports extending between the first plurality of patches and second plurality of patches, the second supports extending between the second plurality of patches and third plurality of patches, the third supports extending between the third plurality of patches and the base.

The alternate preferred embodiment may optionally include a region between the first planar area and second planar area comprising a first resonant cavity and a region between the second planar area and third planar area comprising a second resonant cavity, the first and second resonant cavities each operating to form first and second resonant tank circuits; the capacitance of the first resonant tank circuit being dependent upon the distance between the first and second plurality of patches, and the capacitance of the second resonant tank circuit being dependent upon the distance between the second and third patches, and wherein the inductance of the first and second resonant tank circuits comprises the electrical characteristics of the first and second supports, respectfully.

Referring now to U.S. application Ser. No. 13/184692 (ARL 10-03) entitled "Coplanar-Waveguide Fed Monopole Antenna" filed by Youn M. Lee on Jul. 18, 2011, a planar monopole antenna is disclosed that includes a dielectric substrate with an electrically conductive antenna element adhered to the substrate surface. A coplanar waveguide is also adhered to the same surface of the dielectric substrate to feed the antenna element. A microwave absorber layer is adhered to an opposing rearward surface of the dielectric substrate. The resultant antenna lowers operating frequency compared to an ultrawideband antenna lacking the microwave absorber layer. As a result, the lowest operating frequency of the ultrawideband antenna is lowered by a factor of five when approximately one-inch thick microwave absorber was added to the opposite side of the antenna element and coplanar waveguide.

Referring now to FIGS. 1-3C, the preferred embodiment 100 comprises three major subassemblies: an ultra-wideband antenna 20, a director 10, and an electromagnetic reflective structure 30. Note that although the director element 12 appears smaller than the antenna element 22, the director element may be the same size as element or monopole 22, or different, depending on wideband, multiple-band requirements. The electromagnetic reflective subassembly 30 may be single resonance, multiple-resonance progressive, or multiple-resonance stacked. The director and the antenna may be bonded together using a foam sheet and adhesive. The director subassembly comprises a patch 12, which may for example be circular, electrically connected to a center conductor of the coplanar waveguide 13, which may be for example rectangular, positioned between two planar waveguides 14 and 15, which may be, for example, rectangular. The director subassembly 11 may be positioned or mounted to a dielectric 17, which may be for example, a foam sheet having a thickness of approximately one inch.

The antenna subassembly 20 comprises a circular patch antenna 20 and an underlying dielectric substrate 26. The antenna element 20 is fed by a coplanar waveguide, consisted of ground planes 24, 25 and a center conductor 23. FIG. 2C is a schematic depiction of a preferred embodiment antenna subassembly 20 showing examples of approximate measurements or dimensions of elements and differences or gaps between elements associated with performance characteristics of a given antenna assembly. These parameters include substrate width W, substrate length L, lateral separation h between antenna element 22 and coplanar waveguide, antenna element radius r, separation gap g between a ground plane and the center conductor 23, width of ground plane Gw, lateral extent of ground plane GL, the center conductor of the coplanar waveguide width Cw, and the thickness of the dielectric material t. As an example, the dimensions may be as follows. The substrate width W may be, for example, a 1.575 millimeter thick FR-4 substrate. The dimensions may, for example, be as follows: w=152 mm, L=152 mm, h=3 mm, r=55 mm, g=0.393 mm, Gw=73.607 mm. GL=20 mm, Cw=4 mm, t=1.575 mm.

Figure 3A:
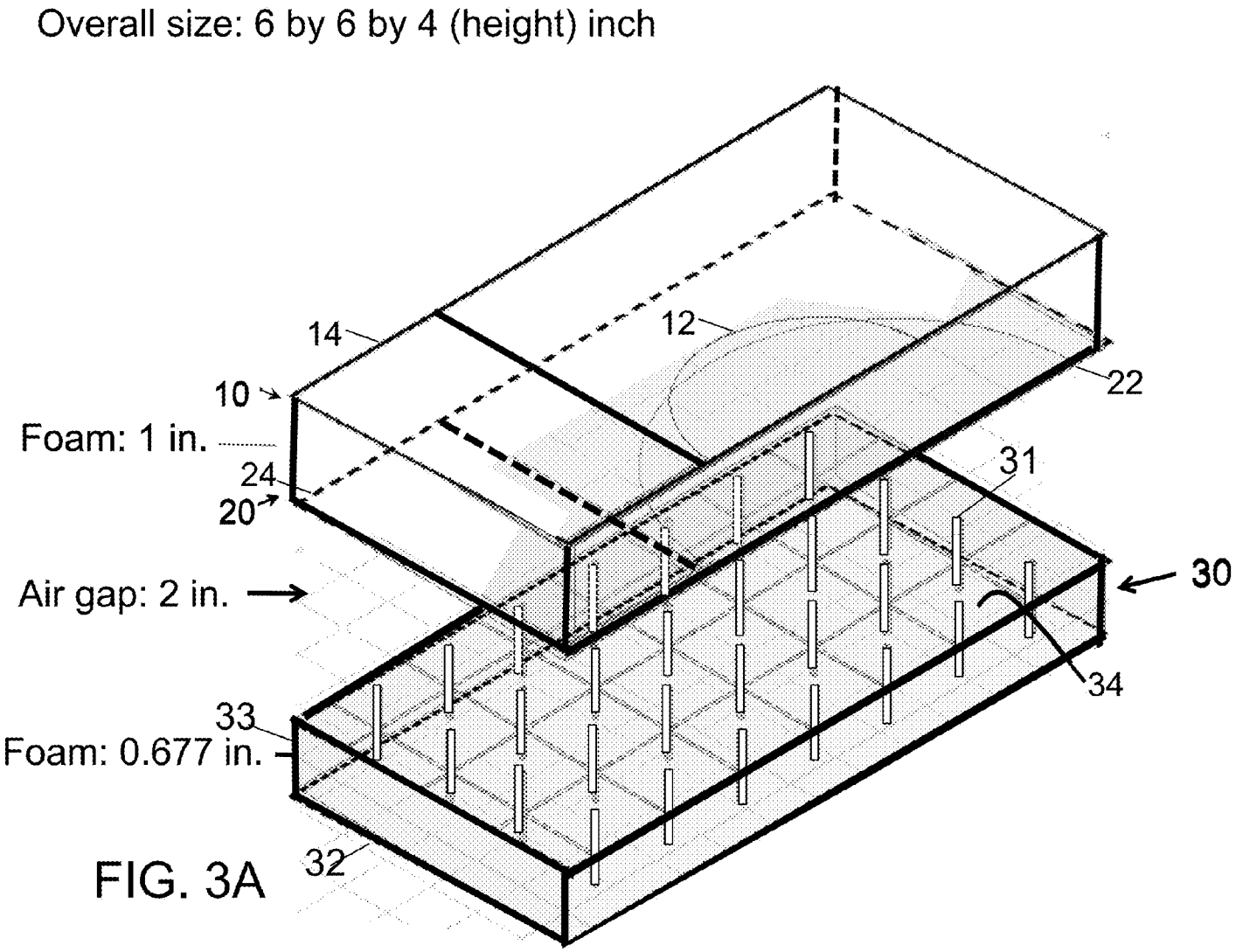
FIG. 3A is a schematic illustration of a preferred embodiment showing one half of the antenna, director, electromagnetic reflective structure showing examples of dimensions of the preferred embodiment of FIG. 1A

FIG. 3A is an illustration showing examples of dimensions of an alternate preferred embodiment. For example, the approximate overall dimensions may be 6 inch by 6 inch by 4 inch (height). The foam layer or sheet 17 may be approximately one inch thick. In the embodiment shown in FIG. 3A, there is an air gap of approximately 2 inches between the antenna subassembly 20 and the electromagnetic reflective subassembly 30. Also shown in FIG. 3A is a foam having a dimension of approximately 0.677 inch in the electromagnetic reflective subassembly 30.

Figure 3B:
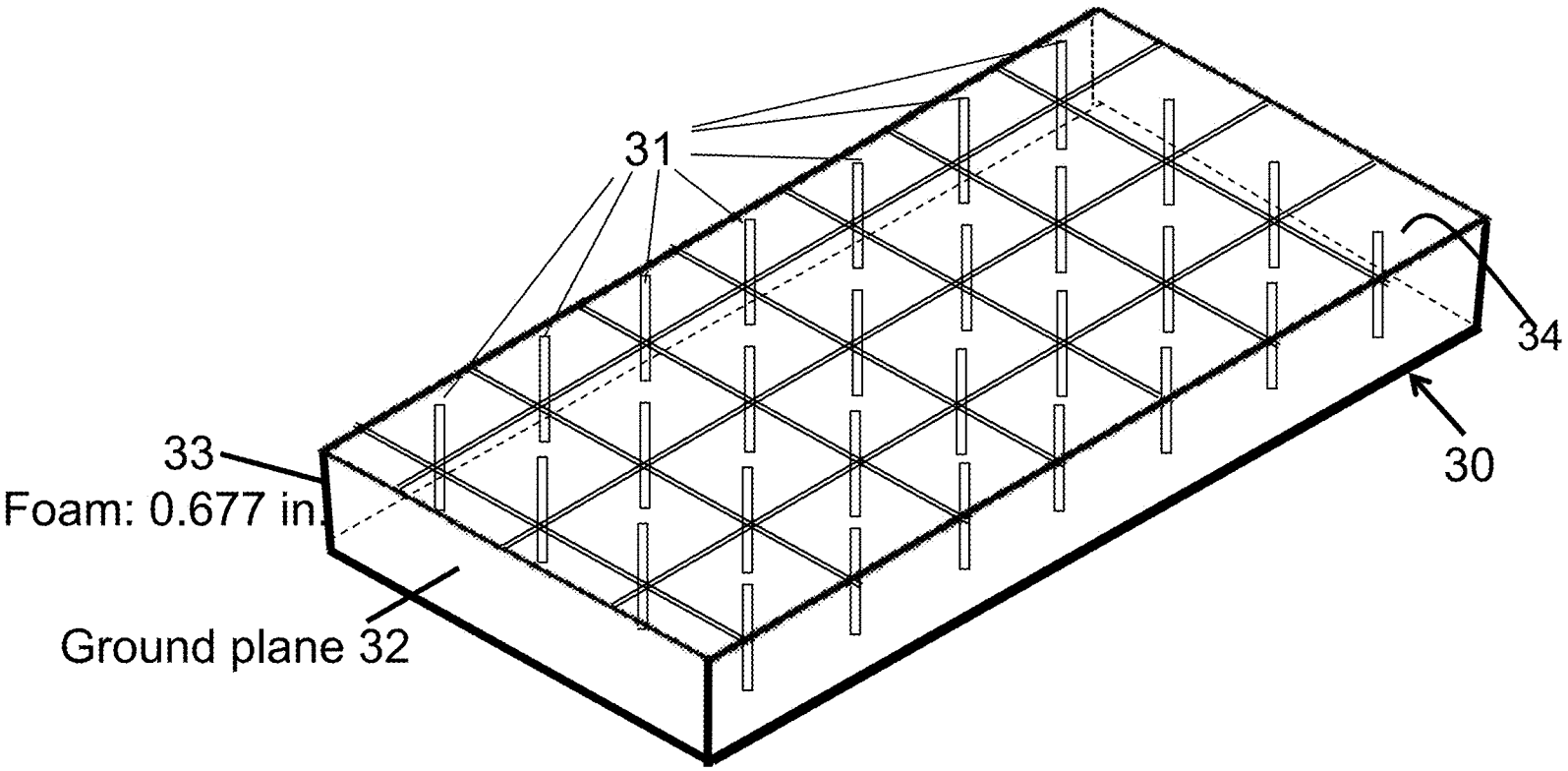
FIG. 3B is a schematic illustration showing the electromagnetic reflective subassembly 30.
Figure 3C:
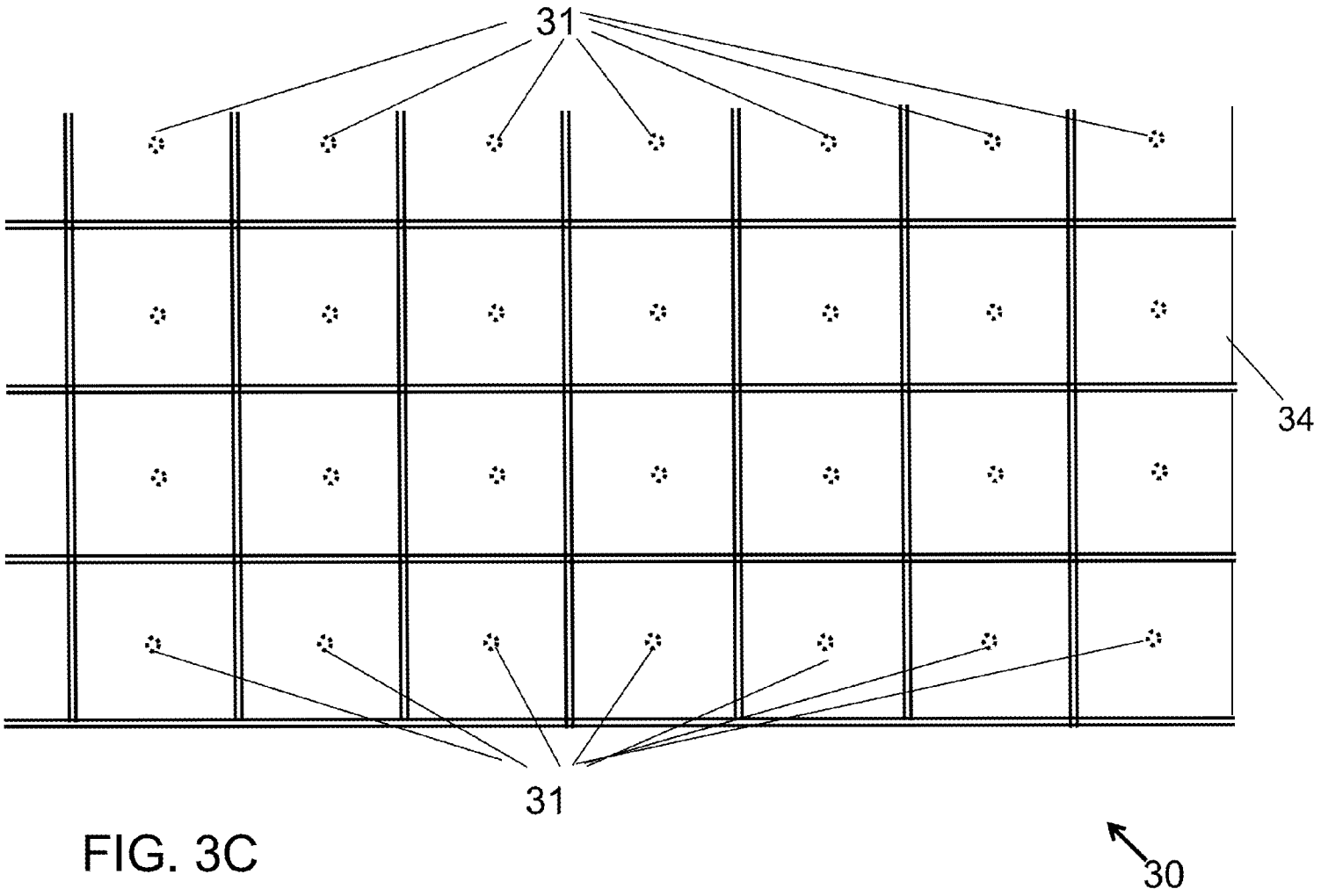
FIG. 3C is a schematic overhead partial view showing the electromagnetic reflective subassembly 30 of FIG. 3B and further depicting the outlines of the patches 34 and vias 31, which appear in dotted line fashion. The vias are located underneath the patches 34, which extend in rows and columns across the electromagnetic reflective subassembly 30.

FIG. 3B is an illustration showing the electromagnetic reflective subassembly 30 embodiment. This subassembly 30 may be used in conjunction with the embodiments of FIGS. 1A-1C. The electromagnetic reflective subassembly 30 comprises vias 31. Although only some of the vias are labeled, the vias 31 extend in rows and columns across the entire subassembly. The vias 31 appear in dotted line fashion and are located underneath and provide electrical contact between patches 34 and the ground plane 32. Although only one of the patches 34 is labeled, the patches 34 extend in rows and columns across the entire subassembly 30. Also shown in FIG. 3A is a foam 33 having a thickness of approximately 0.677 inch in the electromagnetic reflective subassembly 30. Also shown in FIG. 3B is the ground plane 32.

Figure 3D:
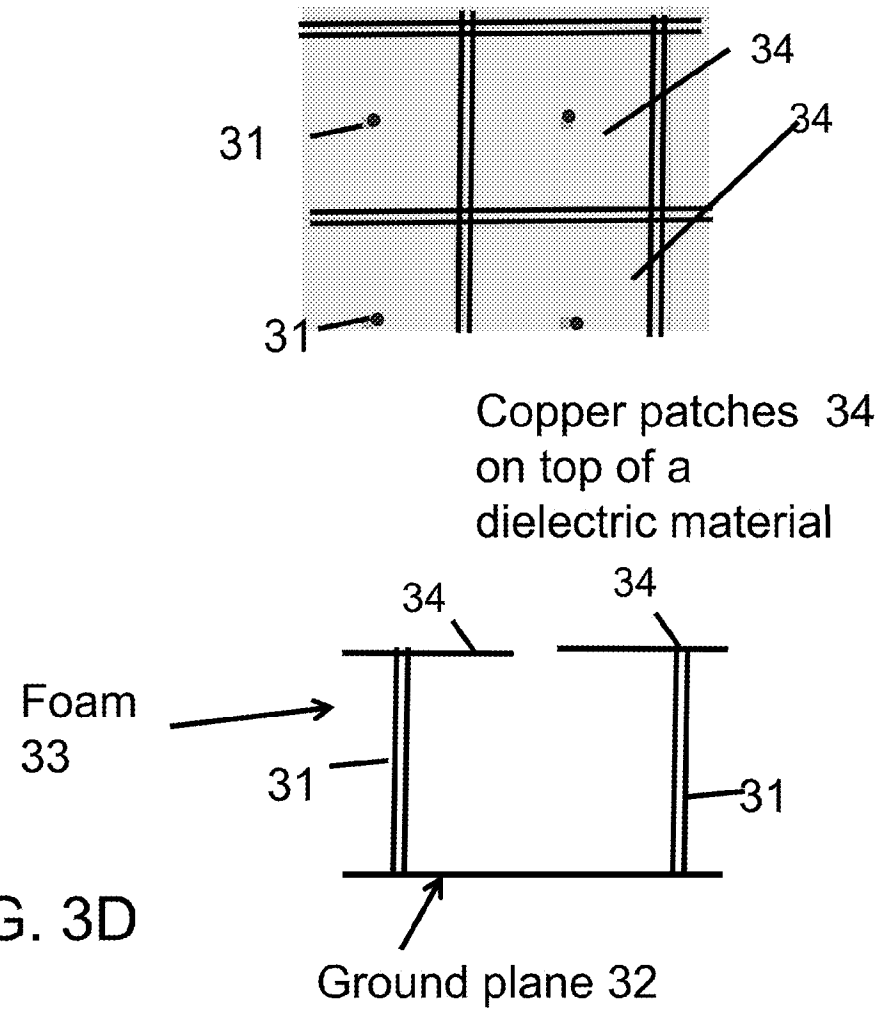
FIG. 3D is a schematic illustration showing an overhead view (top) and side view (bottom) of the patches 34 and vias 31 of the electromagnetic reflective subassembly 30.

FIG. 3D is a schematic illustration showing an overhead view (top) and side view of the patches 34 and vias 31 of the electromagnetic reflective subassembly 30.

While FIG. 1 depicts a prototypical circular antenna element with the other portions of the antenna subassembly 20 being rectilinear, it is appreciated that dimensions of the various components of the antenna subassembly 20 need to be very specific to work properly. By way of example, a radiating element is also formed in other geometric shapes and polygons. An antenna element 22, center conductor 23, and ground planes 24 and 25 are formed of highly conductive materials conventional to the art illustratively including copper, copper alloys, gold, gold alloys, and combinations thereof. A dielectric substrate 26 is readily formed from a variety of dielectric substances through recognition that the dielectric constant of the substrate 26 is relevant in determining the physical size of an antenna. Dielectric substrates operative herein illustratively include fiberglass reinforced epoxy laminate (NEMA designation FR-4), polytetrafluoroethylene (PTFE) composites reinforced with glass microfibers (such as those commercially available under the trade name DUROID®); and ceramic material such as alumina.

Figure 2A:
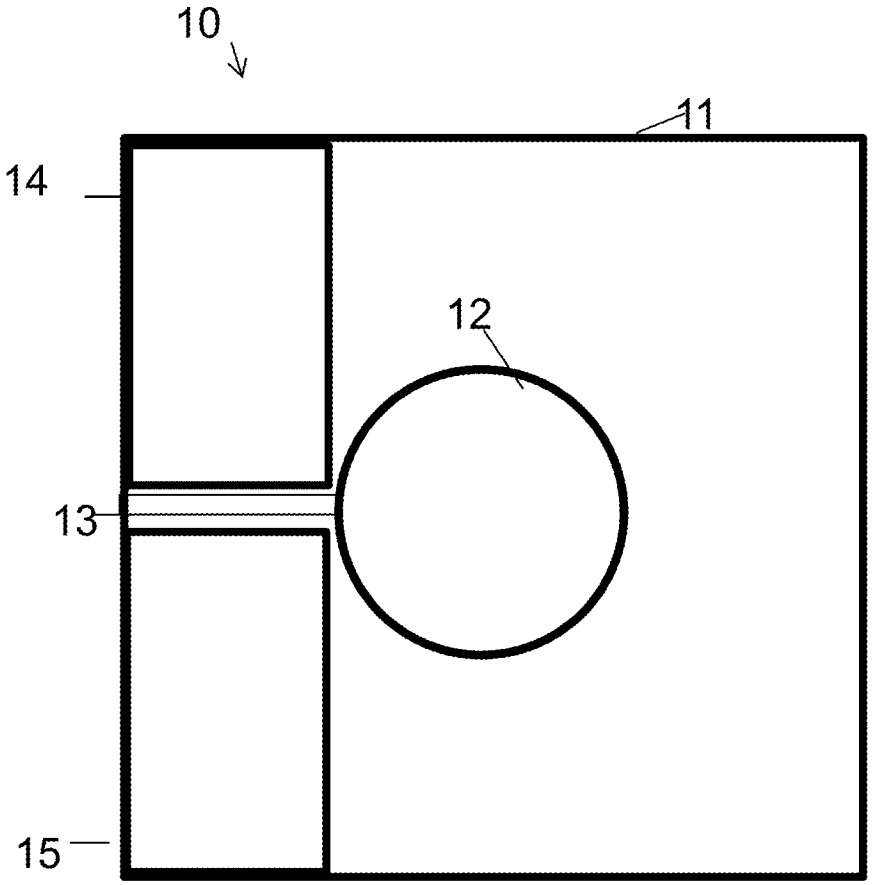
FIG. 2A is a schematic illustration of a preferred embodiment director subassembly 10 showing a gap between the center conductor 13 and two ground planes of the coplanar waveguide 14 and 15.
Figure 2B:
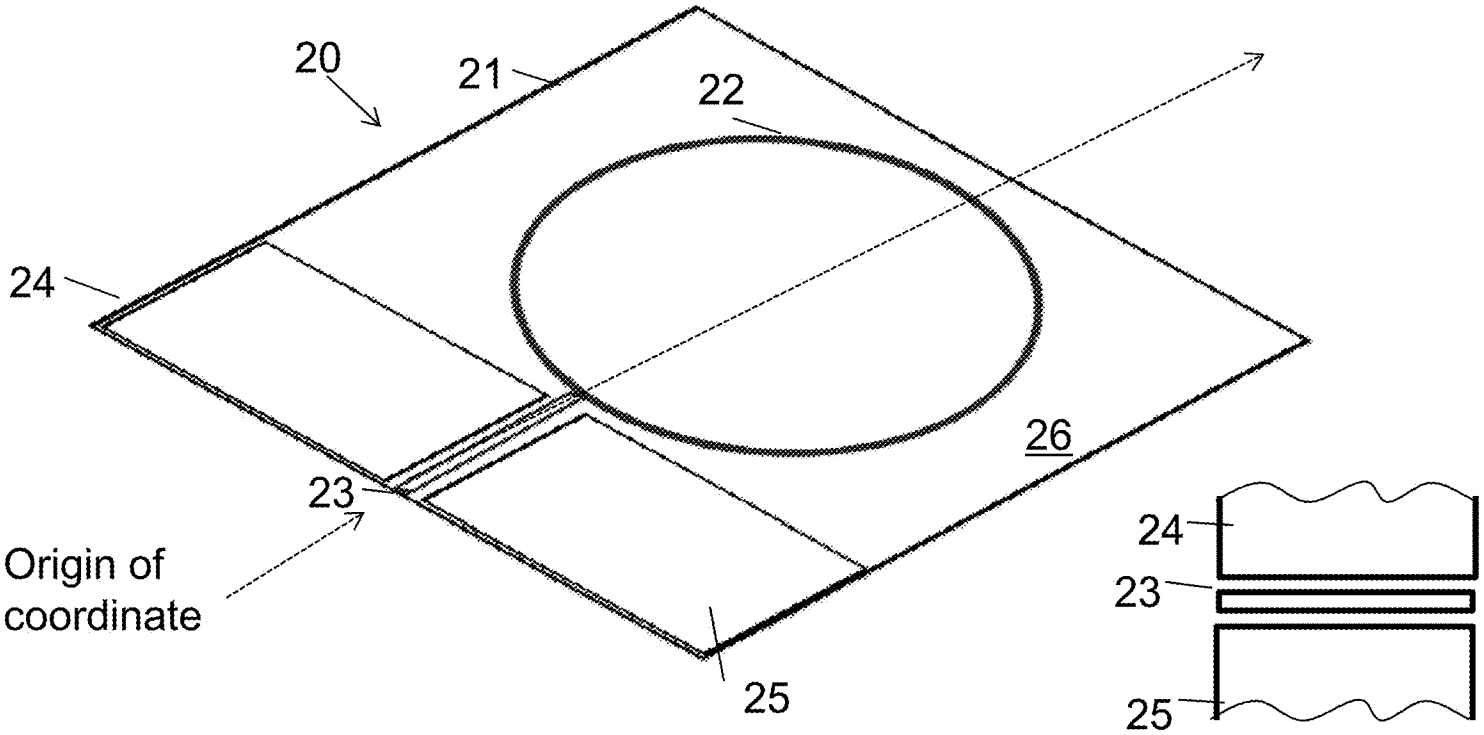
FIG. 2B is a schematic illustration of a preferred embodiment antenna subassembly 20 showing an antenna element 22 electrically connected to a center conductor 23 and a gap between the center conductor 23 and two ground planes of the coplanar waveguide 24 and 25.
Figure 2C:
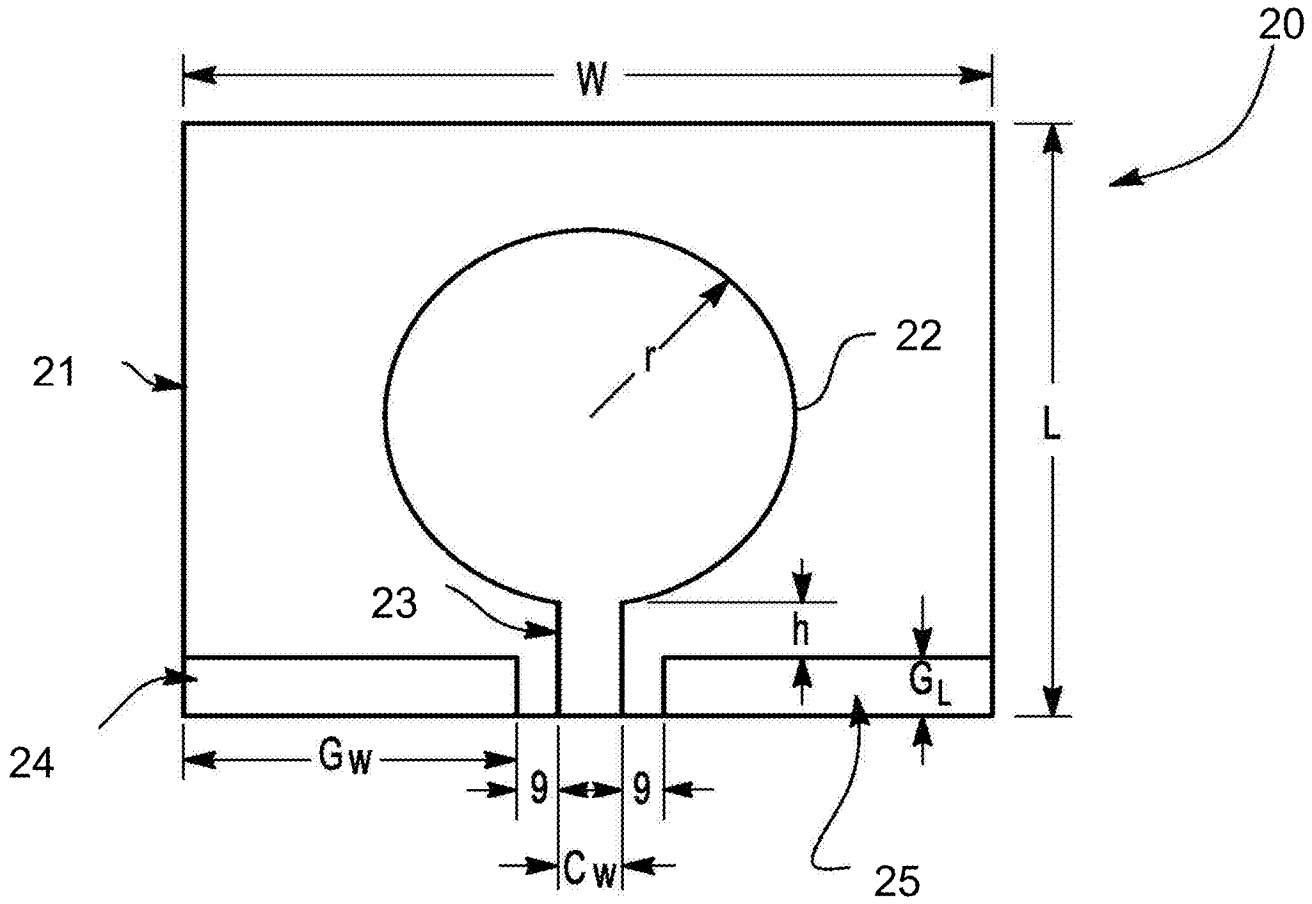
FIG. 2C is a schematic depiction of a preferred embodiment antenna subassembly 20 showing examples of approximate measurements or dimensions of elements and differences or gaps between elements.

FIG. 2B is a schematic illustration of a preferred embodiment antenna subassembly 20 showing an antenna element 22 electrically connected to a center conductor 23 and a gap between the center conductor 23 and two planar waveguides 24 and 25. As shown in FIG. 2B, the subassembly antenna 20 comprises a dielectric material 21, a highly conductive circular radiator 22 such as copper, two ground planes 24, 25, central conductor 23, and side with specific gap and width, which form a coplanar waveguide (CPW). The center conductor 23 is connected to the radiator 22. For example, in one particular design, the size of the dielectric material may be, for example, 15.24×15.24×0.157 cm, the dielectric constant may be, for example, 3.66, and loss tangent value may be, for example, 0.004. The ground plane may be, for example, 4.064 cm long, the center conductor may be, for example, 0.4 cm wide, and the gap between a ground plane and the center conductor may be, for example, 0.058 cm. The circular radiator 22 radius may be, for example, 5.08 cm, and its center coordinate may be, for example, (0, 9.44, 0) cm. For reference, the origin of the coordinate is shown in FIG. 1A by the arrows. The two ground planes 24, 25 of the CPW should be shorted using an air bridge, or a coplanar-waveguide-end launcher when the antenna is excited.

For the director subassembly 10, in a directional antenna, a parasitic element is situated in front of the radiator 22 and separated from it by an appropriate fraction of a wavelength. Its function is to intensify radiation in the direction of transmission. In the preferred embodiment, the director subassembly 10 resembles the antenna subassembly 20 except for two items: the dielectric material thickness is, for example, 0.0254 cm and the radius of the radiator 12 is, for example, 2.97 cm. The director subassembly 10 and the antenna subassembly 20 are bonded together using a one inch thick foam sheet 17 and adhesive. Dielectric constant of the foam sheet is, for example, 1.05 and loss tangent is, for example, 0.0002. The two ground planes of the director should be shorted using an air bridge.

The electromagnetic reflective structure is made of small highly conductive patches such as copper supported by a thin dielectric and foam material, located 5.08 cm below the antenna, as shown in FIG. 1. Bottom of the electromagnetic reflective structure may have a thin copper sheet. Each of the patches 34 in the electromagnetic reflective structure may have dimensions of, for example, $0.198\times0.198\times2.54\times10^{-4}$ cm and grounded by using a via at the center of the patch. In a preferred embodiment, the gap between patches is 0.075 cm. Overall size of the reflective structure is, for example, 15.24×15.24×1.73 cm. The dielectric material is, for example, 0.0127 cm-thick, dielectric constant is, for example, 2.2, and loss tangent is, for example, 0.0009. Detailed close up top and a side view of the electromagnetic reflective structure is also included in the FIG. 3. An air gap exists between the antenna subassembly 20 and the electromagnetic reflective structure 30 of approximately, in this example, 5.08 cm.

Another embodiment of the electromagnetic reflective structure can be a broad-band, multiple-resonance structure. This is applied relative to the circular monopole antenna as described above, with the exception of constructing the electromagnetic reflective structure with tiers of different dimensions that resonate at different frequencies. The tiers can be co-planar or stacked. The design also may be free of the grounding vias. The dimensions of the electromagnetic reflective structure patches and the spacing between them are adjusted to produce the inductive effects generated by the vias. This can apply to the single or multiple-resonance electromagnetic reflective structure. The elimination of the vias simplifies the fabrication of the electromagnetic reflective structure considerably.

Electromagnetic Reflecting Structure

In accordance with the principles of the present invention, Equations 1 through 5 give the surface impedance, resonance frequency, inductance, capacitance and the bandwidth, respectively, of an electronic reflecting structure 30, 300. Around the resonance frequency the surface impedance of the electronic structure 30, 300 is very high, and thus does not support a surface wave, so the incident wave is reflected in-phase, which helps enhance the forward radiation of the antenna placed on the surface. A wave incident on a perfect electric conductor (PEC) is reflected 180 degrees out of phase. Since the total tangential component has to go to zero, this results in the reflected wave cancelling with the incident wave and resulting in a null in the radiation pattern at boresight. The band gap of a structure 30, 300 is defined as the frequency band where the reflection phase is in the +90 to −90 degree range. Reflection phase of the electronic structure is calculated by using a plane wave incidence, determining the phase of the received signal at boresight in the far field, and then comparing it with a known reflection phase (e.g. PEC plate). Uniform Electronic Band Gap structures usually have narrow bandwidth, which is the primary reason why they are not widely used with broadband antennas.

$$Z_s = \frac{j\omega L}{1-\left(\frac{\omega}{\omega_0}\right)^2} \tag{1}$$

$$\omega_0 = \frac{1}{\sqrt{LC}} \tag{2}$$

$$L = \mu_0 t \tag{3}$$

$$C = \frac{W\varepsilon_0(1+\varepsilon_r)}{\pi}\cosh^{-1}\left(\frac{2W+g}{g}\right) \tag{4}$$

$$BW = \frac{1}{120\pi}\sqrt{\frac{L}{C}} \tag{5}$$

To increase the bandwidth of a uniform Electronic Band Gap, a progressive electromagnetic reflective structure, formed by cascading uniform electromagnetic reflective structures that resonate at different bands, is proposed in A. I. Zaghloul, S. Palreddy, S. J. Weiss, "A Concept for a Broadband Electromagnetic Band Gap (EBG Structure," Proceedings of the 5th European Conference on Antennas and Propagation (EuCAP), pp 383-387, April 2011, hereby incorporated by reference. Progressive electromagnetic reflective structures can be used with antennas where different parts of the antenna radiate at different frequencies. This design is not a good candidate to use with broadband antennas when the whole structure contributes to the radiation across the band.

The preferred electronic reflecting structure 300, shown in FIGS. 4-9, is for usage with the embodiments of FIGS. 1A-1C, 2A-2C and 3A, and comprises a stacked electromagnetic reflective structure 300 formed by stacking layers that resonate at different frequencies within the operating band. This is reported in S. Palreddy, A. I. Zaghloul, Y. M. Lee, "An Octave-Bandwidth Electromagnetic Band Gap (EBG) Structure for a UWB Antenna," European Conference on Antennas and Propagation (EuCAP), March 2012, hereby incorporated by reference. The outer most layer (closest to the antenna (not shown)) comprises patches 111-118, which are separated by gaps 119-125 as shown in FIGS. 4A and 4B. The patches 111-118 may be made from a metallic material such as copper, gold or silver and may be placed on a nonconductor substrate such as silicon, in that case the silicon would extended in the gaps 119-125. The silicon substrate would extend across the area shown and patches 111-118 may be formed by etching a copper sheet formed on the substrate layer. Patches 111-118 are supported by supports 126 through 132, as shown in FIGS. 4A and 4B, but optionally may be supported by a singular piece of dielectric such as ceramic or foam material to thereby eliminate the need for supports 126-132. The second layer comprises patches 141 through 144, which may be made from a metallic material such as copper, gold or silver and may be placed on a nonconductor substrate such as silicon. Patches 141 through 144 are separated by gaps 145-148 which produce a different resonance effect than that of patches 111-118 and gaps 119-125. Patches 141 through 144 may be formed by etching a metallic sheet formed on the substrate layer; in that case the substrate layer, such as for example, silicon, would extend in the gaps 146, 147 and 148. The second layer of patches 141 through 144 may be supported by the supports 151 through 154, but optionally may be supported by a singular piece of dielectric such as ceramic or foam material to thereby eliminate the need for supports 151 through 154. The third layer of patches 155 and 156 are separated by a gap 157, which may be produced by etching a metallic sheet. The patches 156 and 157 may be made from a metallic material such as copper, gold or silver and may be placed on a nonconductor substrate such as silicon, in that case the silicon would extended in the gap 157. The third layer of patches 155 through 156 may be supported by the supports 161 and 162, but optionally may be supported by a singular piece of dielectric such as ceramic or foam material to thereby eliminate the need for supports 161 and 162. The fourth layer comprises patch 160, which may be made from a metallic material such as copper, gold or silver and may be placed on a nonconductor substrate such as silicon. It can be appreciated by those of ordinary skill in the art that each of the four layers provide a reflective structure wherein the bandwidth of the structure is improved by stacking layers that resonate at frequency bands that extend over different frequency band ranges yet the resonate frequency ranges of the layers 110, 140, 150 and 160 are substantially close to one other so as to provide a wide band-gap area of operation for the entire assembly. Note that FIG. 4B is side view of the assembly 300 shown in FIG. 4A.

As discussed in detail in U.S. application Ser. No. 13/848,380 entitled "Wideband Electromagnetic Stacked Reflective Surface," by Dr. Amir Ibrahim Zaghloul and Dr. William O'Keefe Coburn filed Mar. 21, 2013 (ARL 12-19), the dimensions of the stacked layers 110, 140, 150 and 160 are functions of the desired resonance frequencies. Using FEKO (see FEKO: Computational Electromagnetics EM Software and Systems Pty Ltd. http://www.feko.info), the reflection phase of the stacked electromagnetic reflective structure was computed and, compared with the reflection phase of a uniform electromagnetic reflective structure. The dimensions of the uniform electromagnetic reflective structure are selected such that it resonates at 0.9 GHz. The dimensions of the 3-layer stacked electromagnetic reflective structure are selected such that the bottom layer resonates at 0.6 GHz, the middle layer resonates at 0.9 GHz, and the top layer resonates at 1.1 GHz.

The stacked electronic reflective structure concept described here can serve as a broadband reflector in many antenna applications without the restriction of being a quarter-wavelength from the source. Its main use is to reduce the depth of cavity backed antennas which require broader bandwidth than conventional electronic reflector structure designs can provide. This allows the integration of conformal antennas with reduced depth onto military platforms. Lower profile antennas have many advantages on the modern battlefield. The stacked electronic reflector structure concept is an enabling technology for advanced antenna designs and vehicle integrated antennas compared to bolt-on antenna installations.

The concept and/or scope of the present invention is not limited to three layers and additional layers can further extend the bandwidth at the expense of increased fabrication complexity. For some antenna types non-uniform or progressive electronic reflector layers can be incorporated to improve performance. Additional layers can be used to extend bandwidth and/or increase gain where the design of the electronic reflector structure is specific to the antenna and can be readily optimized for a given application. The fabrication cost and complexity are current issues being addressed. In particular an approach that does not use vertical vias is being pursued to reduce cost, weight and fabrication complexity. Such variations are also covered by this concept disclosure and are important for the further development of electronic reflector structures in practical antenna installations.

The electromagnetic reflective structure 300 affords a way to increase the bandwidth of a single uniform electronic reflective structure by stacking uniform electronic reflective structure layers that resonate at different frequencies within the desired frequency band. The performance of the stacked electronic reflective structure is validated by using it with a monopole UWB antenna. Its performance is compared with different loading structures to demonstrate its superiority for many antenna applications. Boresight gain, gain patterns and return loss of the antenna are compared under the loading conditions of free space, metal plate, uniform single-resonance electronic reflective structure, and stacked triple-resonance electronic reflective structure.

Figure 5:
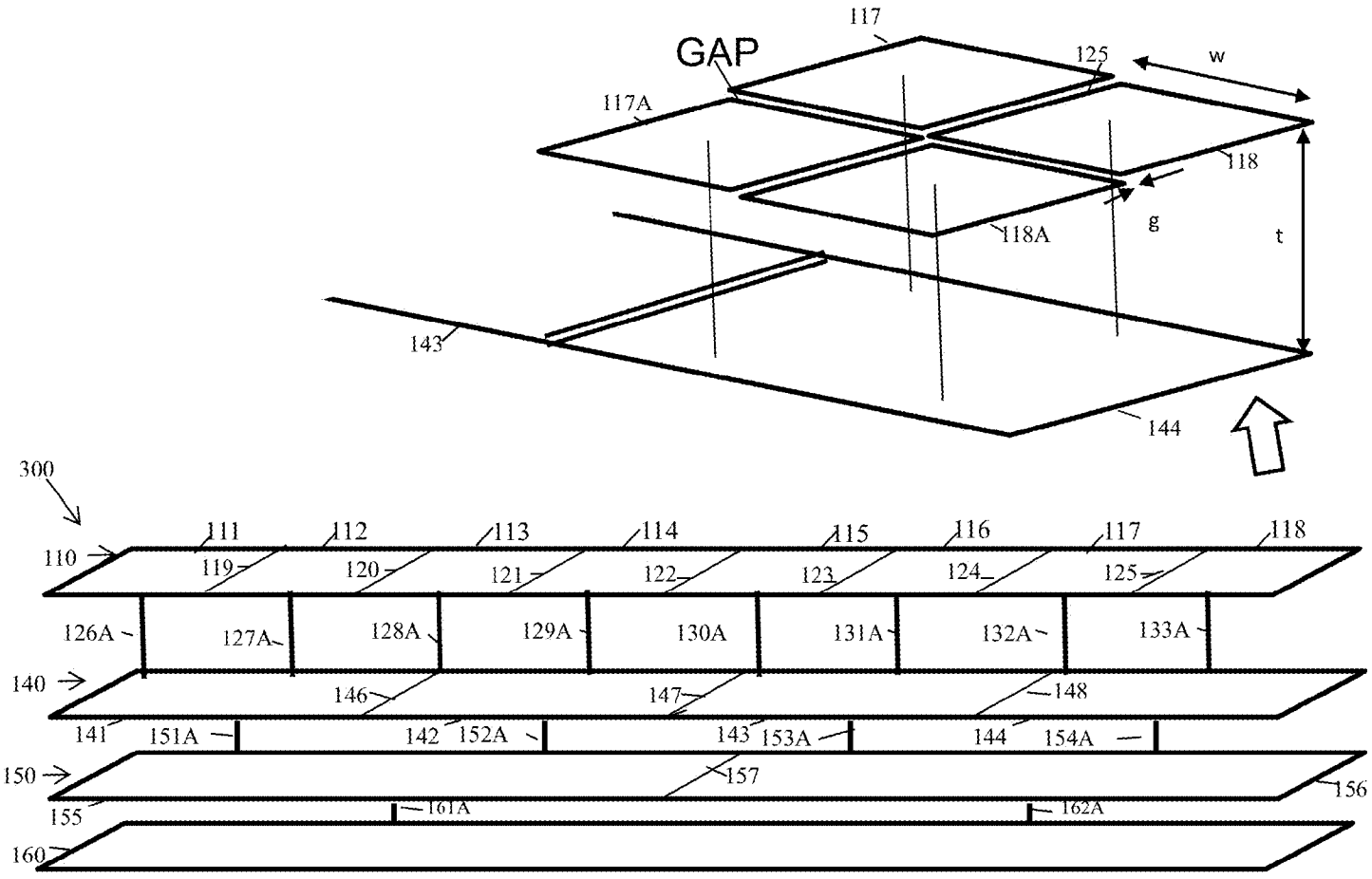
FIG. 5 is a view of a section of the electromagnetic reflective subassemby schematic illustration showing different periodicity in the three-layered electromagnetic reflective structure reflective subassembly 200.

FIG. 5 is an isometric view showing the different periodicity in a three layer stacked electromagnetic reflective subassembly 300, showing patches 117A and 118A extending in the manner shown.

FIG. 6 is a schematic illustrations depicting an alternative electromagnetic reflective subassembly 300 comprising a stacked electromagnetic reflective structure formed by stacking layers that resonate at different frequencies within the operating band. The outer most layer (closest to the antenna (not shown)) comprises patches 111-118, which are separated by gaps 119-125 as shown in FIG. 6. The patches 111-118 may be made from a metallic material such as copper, gold or silver and may be placed on a nonconductor substrate such as silicon, in that case the silicon would extended in the gaps 119-125. The silicon substrate would extend across the area shown and patches 111-118 may be formed by etching a copper sheet formed on the substrate layer. Patches 111-118 are supported by supports 126A through 132A, as shown in FIG. 6, but optionally may be supported by a singular piece of dielectric such as ceramic or foam material to thereby eliminate the need for supports 126A-132A, as shown schematically in FIG. 7. The second layer comprises patches 141 through 144, which may be made from a metallic material such as copper, gold or silver and may be placed on a nonconductor substrate such as silicon. Patches 141 through 144 are separate by gaps 145-148 which produce a different resonance effect than that of patches 111-118 and gaps 119-125. Patches 141 through 144 may be formed by eching a metallic sheet formed on the substrate layer; in that case the substrate layer, such as for example, silicon, would extend in the gaps 146, 147 and 148. The second layer of patches 141 through 144 may be supported by the supports 151A through 154A, but optionally may be supported by a singular piece of dielectric such as ceramic or foam material to thereby eliminate the need for supports 151 through 154. The third layer of patches 155 and 156 are separated by a gap 157, which may be produced by etching a metallic sheet. The patches 156 and 157 may be made from a metallic material such as copper, gold or silver and may be placed on a nonconductor substrate such as silicon, in that case the silicon would extended in the gap 157. The third layer of patches 155 through 156 may be supported by the supports 161A and 162A, but optionally may be supported by a singular piece of dielectric such as ceramic or foam material to thereby eliminate the need for supports 161A and 162A. The fourth layer comprises patch 160, which may be made from a metallic material such as copper, gold or silver and may be placed on a nonconductor substrate such as silicon. It can be appreciated by those of ordinary skill in the art that each of the four layers provide a reflective structure wherein the bandwidth of the structure is improved by stacking layers that resonate at frequency bands that extend over different frequency band ranges yet the resonate frequency ranges of the layers 110, 140, 150 and 160 are substantially close to one other so as to provide a wide band-gap area of operation for the entire assembly.

FIG. 7 is side view of an alternative stacked electronic reflecting structure formed by stacking layers that resonate at different frequencies within the operating band. The outer most layer (closest to the antenna (not shown)) comprises patches 111-118, which are separated by gaps 119-125. The patches 111-118 may be made from a metallic material such as copper, gold or silver and may be placed on a nonconductor substrate such as silicon, in that case the silicon would extended in the gaps 119-125. The silicon substrate would extend across the area shown and patches 111-118 may be formed by etching a copper sheet formed on the substrate layer. Patches 111-118 may be supported by a singular piece of dielectric such as ceramic or foam material to thereby eliminate the need for supports. The second layer comprises patches 141 through 144, which may be made from a metallic material such as copper, gold or silver and may be placed on a nonconductor substrate such as silicon. Patches 141 through 144 are separate by gaps 145-148 which produce a different resonance effect than that of patches 111-118 and gaps 119-125. Patches 141 through 144 may be formed by etching a metallic sheet formed on the substrate layer; in that case the substrate layer, such as for example, silicon, would extend in the gaps 146, 147 and 148. The second layer of patches 141 through 144 may be supported by a singular piece of dielectric such as ceramic or foam material to thereby eliminate the need for vertical supports or vias. The third layer of patches 155 and 156 are separated by a gap 157, which may be produced by etching a metallic sheet. The patches 156 and 157 may be made from a metallic material such as copper, gold or silver and may be placed on a nonconductor substrate such as silicon, in that case the silicon would extended in the gap 157. The third layer of patches 155 through 156 may be supported by a singular piece of dielectric such as ceramic or foam material to thereby eliminate the need for vertical supports. The fourth layer comprises patch 160, which may be made from a metallic material such as copper, gold or silver and may be placed on a nonconductor substrate such as silicon. It can be appreciated by those of ordinary skill in the art that each of the four layers provide a reflective structure wherein the bandwidth of the structure is improved by stacking layers that resonate at frequency bands that extend over different frequency band ranges yet the resonate frequency ranges of the layers 110, 140, 150 and 160 are substantially close to one other so as to provide a wide band-gap area of operation for the entire assembly.

Figure 8:
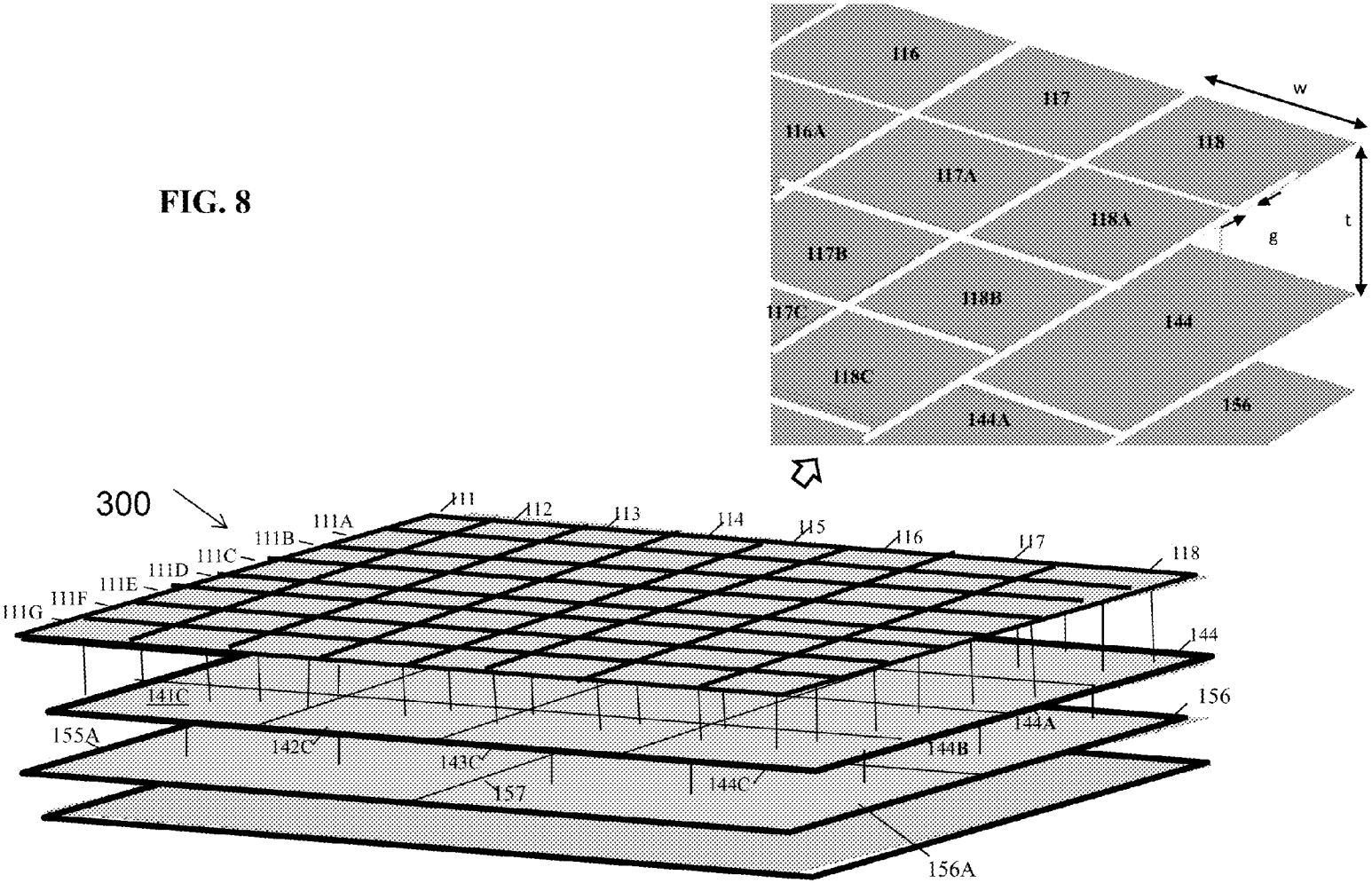
FIG. 8 is a schematic illustration of an alternate electromagnetic reflective subassemby of a preferred embodiment with first layer patches 111 through 114 extending in multiple directions.

FIG. 8 is a schematic illustration of an alternate embodiment with first layer patches 111 through 114 extending in multiple directions. In this alternative preferred embodiment the layers resonate at different frequencies within the operating band. The outer most layer (closest to the antenna (not shown)) comprises patches 111-111G through 118-118G, which are separated by gaps as shown in FIG. 5. The patches 111-111G through 118-118G, may be made from a metallic material such as copper, gold or silver and may be placed on a nonconductor substrate such as silicon, in that case the silicon would extended in the gaps. The silicon substrate would extend across the area shown and patches 111-111G through 118-118G, may be formed by etching a copper sheet formed on the substrate layer. Patches 111-111G through 118-118G, are supported by supports, as shown in FIG. 8, but optionally may be supported by a singular piece of dielectric such as ceramic or foam material to thereby eliminate the need for supports. The second layer comprises patches 141-141C through 144-144C, which may be made from a metallic material such as copper, gold or silver and may be placed on a nonconductor substrate such as silicon. Patches 141-141C through 144-144C are separate by gaps which produce a different resonance effect than that of patches 111-11G through 118-118G and gaps 119-125. Patches 141-141C through 144-144C may be formed by etching a metallic sheet formed on the substrate layer; in that case the substrate layer, such as for example, silicon, would extend in the gaps. The second layer of patches 141-141C through 144-144C may be supported by the supports, but optionally may be supported by a singular piece of dielectric such as ceramic or foam material to thereby eliminate the need for supports. The third layer of patches 155, 155A, 156, and 156A are separated by a gap 157, which may be produced by etching a metallic sheet. The patches 155, 155A, 156, and 156A may be made from a metallic material such as copper, gold or silver and may be placed on a nonconductor substrate such as silicon, in that case the silicon would extended in the gap 157. The third layer of patches 155, 155A, 156, and 156A may be supported by the supports, but optionally may be supported by a singular piece of dielectric such as ceramic or foam material to thereby eliminate the need for supports. The fourth layer comprises patch 160, which may be made from a metallic material such as copper, gold or silver and may be placed on a nonconductor substrate such as silicon. It can be appreciated by those of ordinary skill in the art that each of the four layers provide a reflective structure wherein the bandwidth of the structure is improved by stacking layers that resonate at frequency bands that extend over different frequency band ranges yet the resonate frequency ranges of the layers 110, 140, 150 and 160 are substantially close to one other so as to provide a wide band-gap area of operation for the entire assembly.

Figure 9:
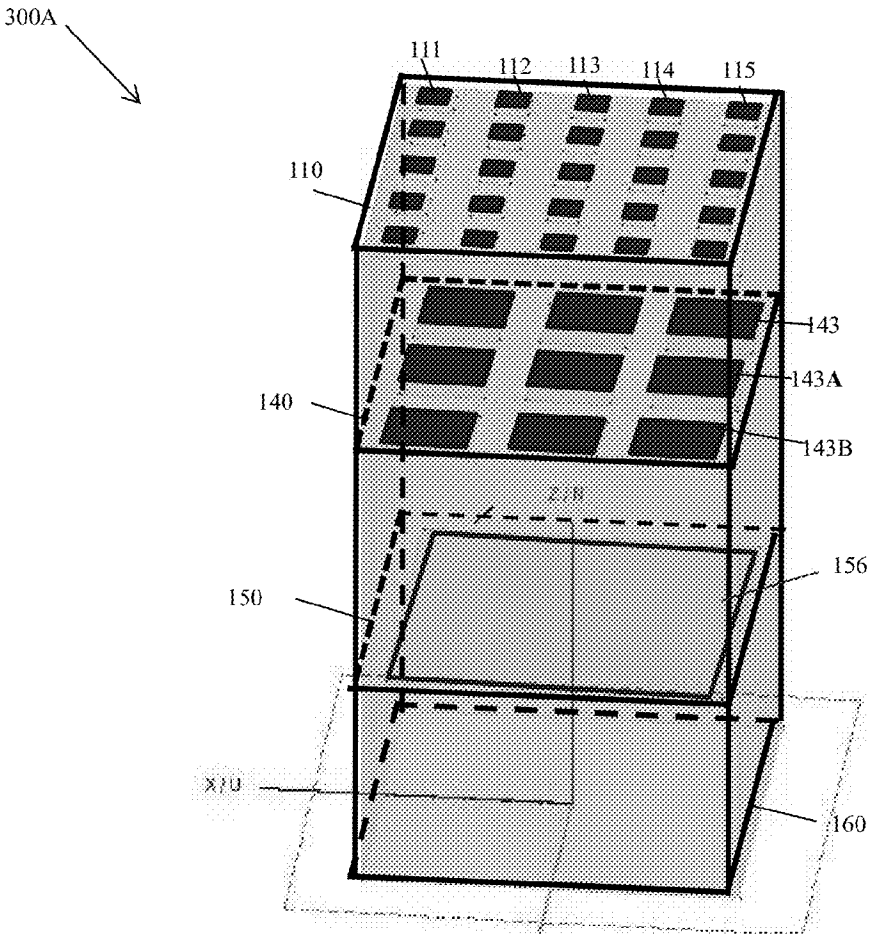
FIG. 9 is a schematic three dimensional configuration of preferred unit cell of an electromagnetic reflector subassembly.

FIG. 9 is a schematic three dimensional configuration of an alternate preferred embodiment wherein the patches 111-115, 141-143, and 56 are supported by a dielectric. In this alternative preferred embodiment the layers resonate at different frequencies within the operating band. The outer most layer (closest to the antenna (not shown)) comprises patches 111-111D through 115-115D, which are separated by gaps as shown in FIG. 9. The patches 111-111D through 115-115D, may be made from a metallic material such as copper, gold or silver and may be placed on a nonconductor substrate such as a dielectric, (such as silicon), in that case the dielectric would extended in the gaps. The silicon substrate would extend across the area shown and patches 111-111D through 115-115D, may be formed by etching a copper sheet formed on the substrate layer. Patches 111-111D though 115-115D, are supported on a singular piece of dielectric such as ceramic or foam material to thereby eliminate the need for supports. The second layer comprises patches 141,141A, 141B through 143, 143A, 143B, which may be made from a metallic material such as copper, gold or silver and may be placed on a nonconductor substrate such as silicon. Patches 141, 141A, 141B through 143, 143A, 143B are separate by gaps which produce a different resonance effect than that of patches 111-111D through 115-115D. Patches 141, 141A, 141B through 143, 143A, 143B may be formed by etching a metallic sheet formed on the substrate layer; in that case the substrate layer, such as for example, silicon, would extend in the gaps. The second layer of patches 141, 141A, 141B through 143, 143A, 143B may be supported by a singular piece of dielectric such as ceramic or foam material to thereby eliminate the need for supports. The third layer comprising patch 156, may be made from a metallic material such as copper, gold or silver and may be placed on a nonconductor substrate such as silicon. The third layer may be supported by the supports, but optionally may be supported by a singular piece of dielectric such as ceramic or foam material to thereby eliminate the need for supports. The fourth or base layer 160, which may be made from a metallic material such as copper, gold or silver and may be placed on a nonconductor substrate such as silicon. It can be appreciated by those of ordinary skill in the art that each of the four layers provide a reflective structure wherein the bandwidth of the structure is improved by stacking layers that resonate at frequency bands that extend over different frequency band ranges yet the resonate frequency ranges of the layers 110, 140, and 150 are substantially close to one other so as to provide a wide band-gap area of operation for the entire assembly.

Figure 10:
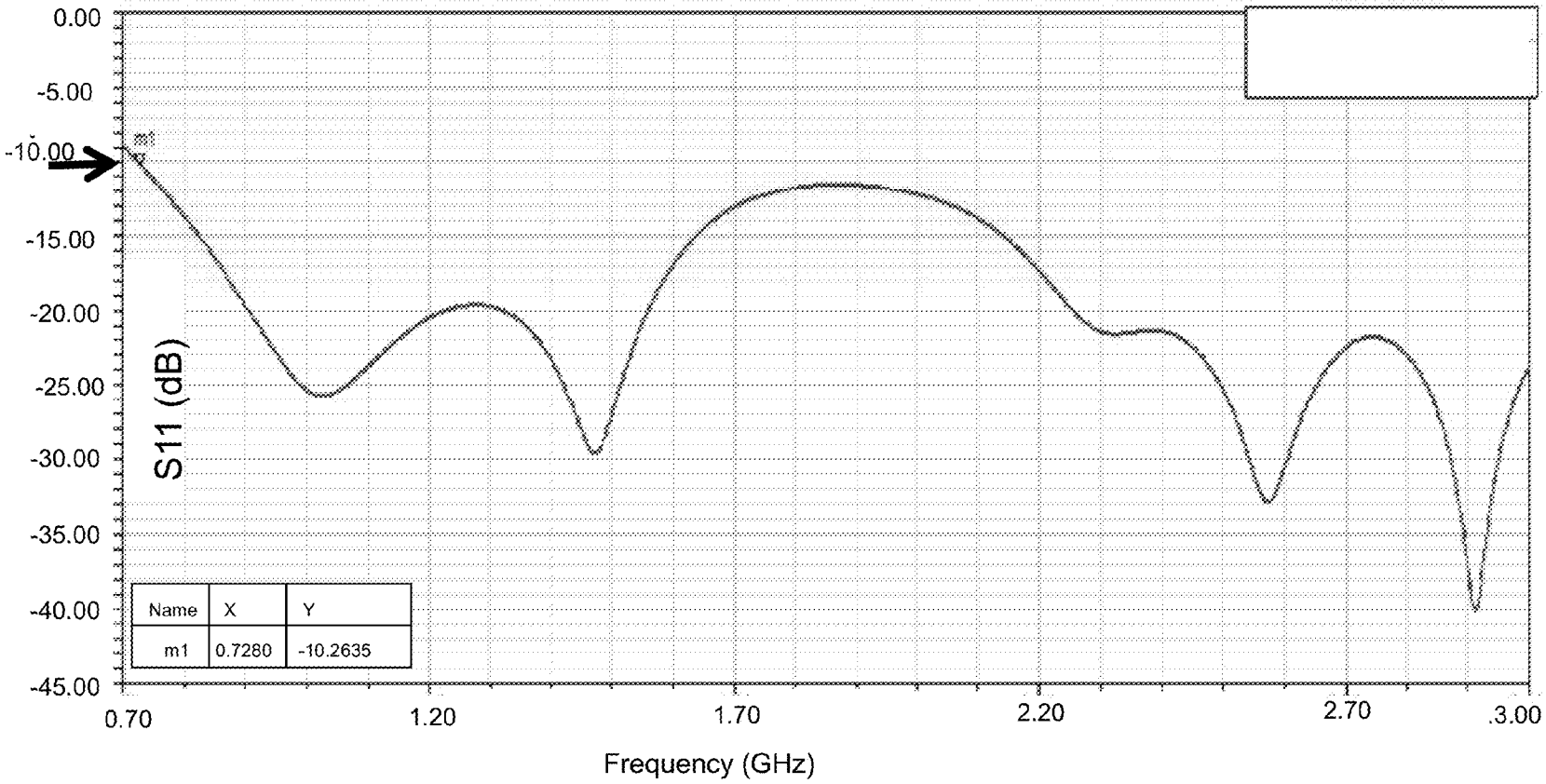
FIG. 10 is an illustration showing a plot of computed return loss (S11) plotted as a function of frequency for a printed circular monopole fed by a co-planar waveguide (CPW) designed for the 700-3000 MHz band. The −10 dB line is indicated with bold letters and an arrow.
Figure 11:
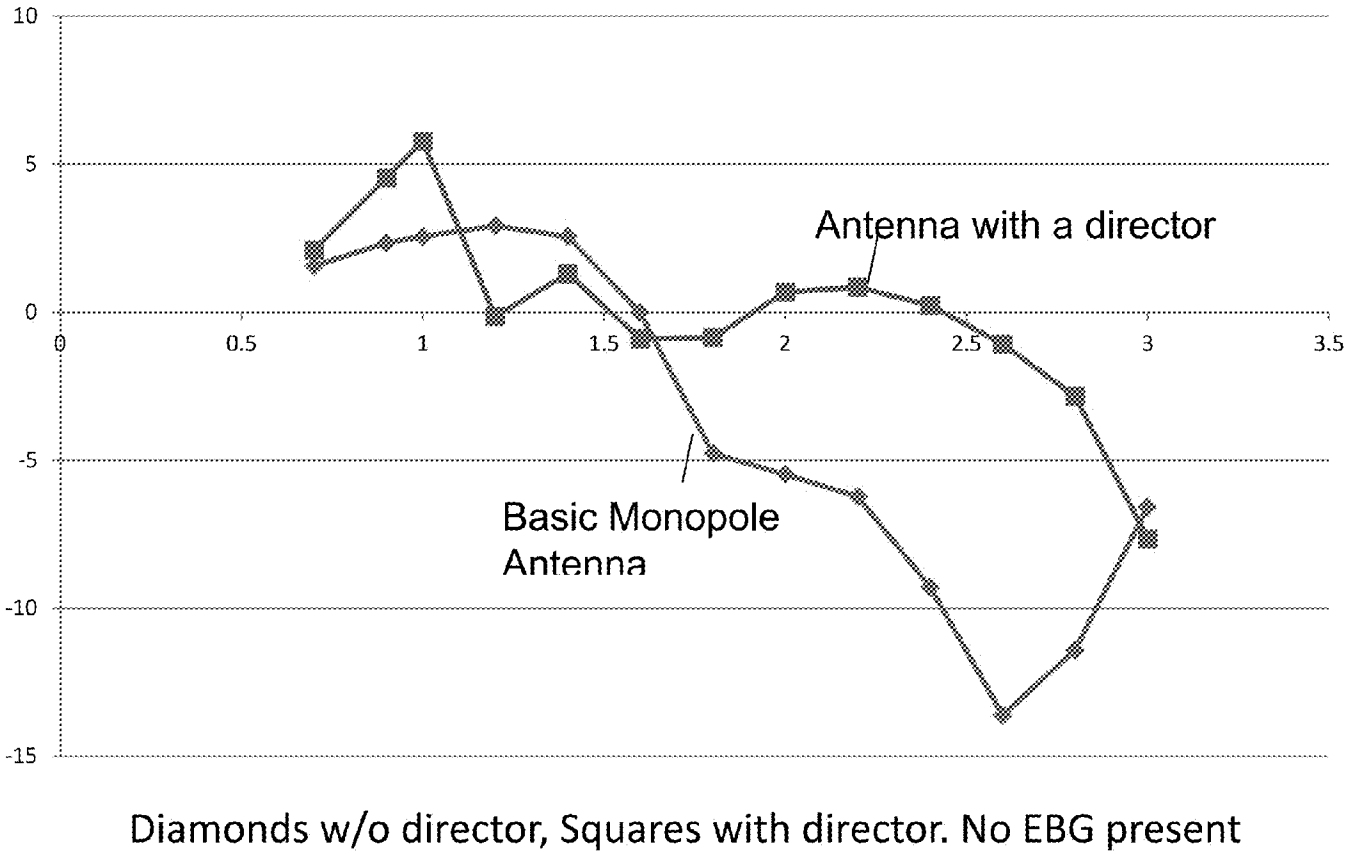
FIG. 11 is an illustration showing a plot of realized gain of the antenna computed from 700 MHz-3 GHz obtained by adding a monopole of similar or smaller diameter in front of the circular monopole described in FIG. 10 which changes the omni-directional beam in the H-plane to a more directive beam.

An antenna was simulated using a full-wave three dimensional High Frequency Structure Simulator (HFSS), and its return loss was computed, which is shown in FIG. 10. Specifically, FIG. 10 illustrates the return loss of printed circular monopole fed by a co-planar waveguide (CPW) designed for the 700-3000 MHz band. As indicated in the figure, the values are mostly below −10 dB for frequencies from 700 MHz to 3000 MHz. FIG. 11 is an illustration showing a plot of realized gain of the antenna computed from 700 MHz-3 GH obtained by adding a monopole of similar or smaller diameter in front of the circular monopole described in FIG. 10 which changes the omni-directional beam in the H-plane to a more directive beam. The second monopole acts as director, and is placed at an optimum height above the CPW-fed monopole. The line with diamond tick marks is the realized gain of the basic monopole antenna. Antenna with a director was also computed and their combined result is plotted with square tick marks.

Figure 12:
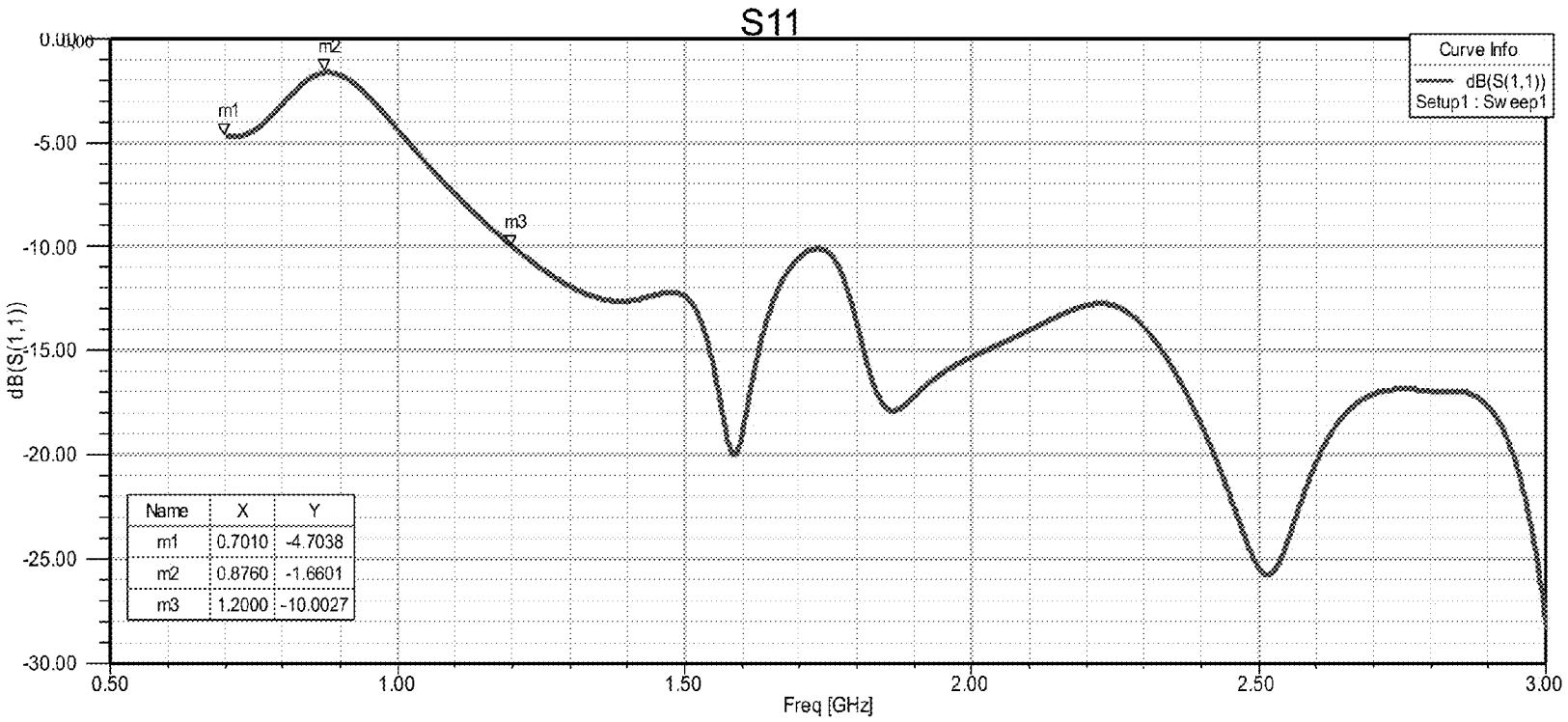
FIG. 12 is an illustration showing a plot for S11 of an antenna with a director. Beyond the third marker is −10 dB in return loss, starting at 1.2 GHz.

The performance realized by adding a director to the antenna is shown FIGS. 11 and 12, realized gain (square tick marks) and return loss, respectively. FIG. 11 illustrates realized gain of a printed circular monopole fed by a CPW (diamond-shaped plot) as compared with the director-enhanced monopole (square-shaped plot) across the 700-3000

MHz band. As can be seen in FIG. 11, significant improvement was achieved in realized gain for frequencies above 1.6 GHz.

Figure 13:
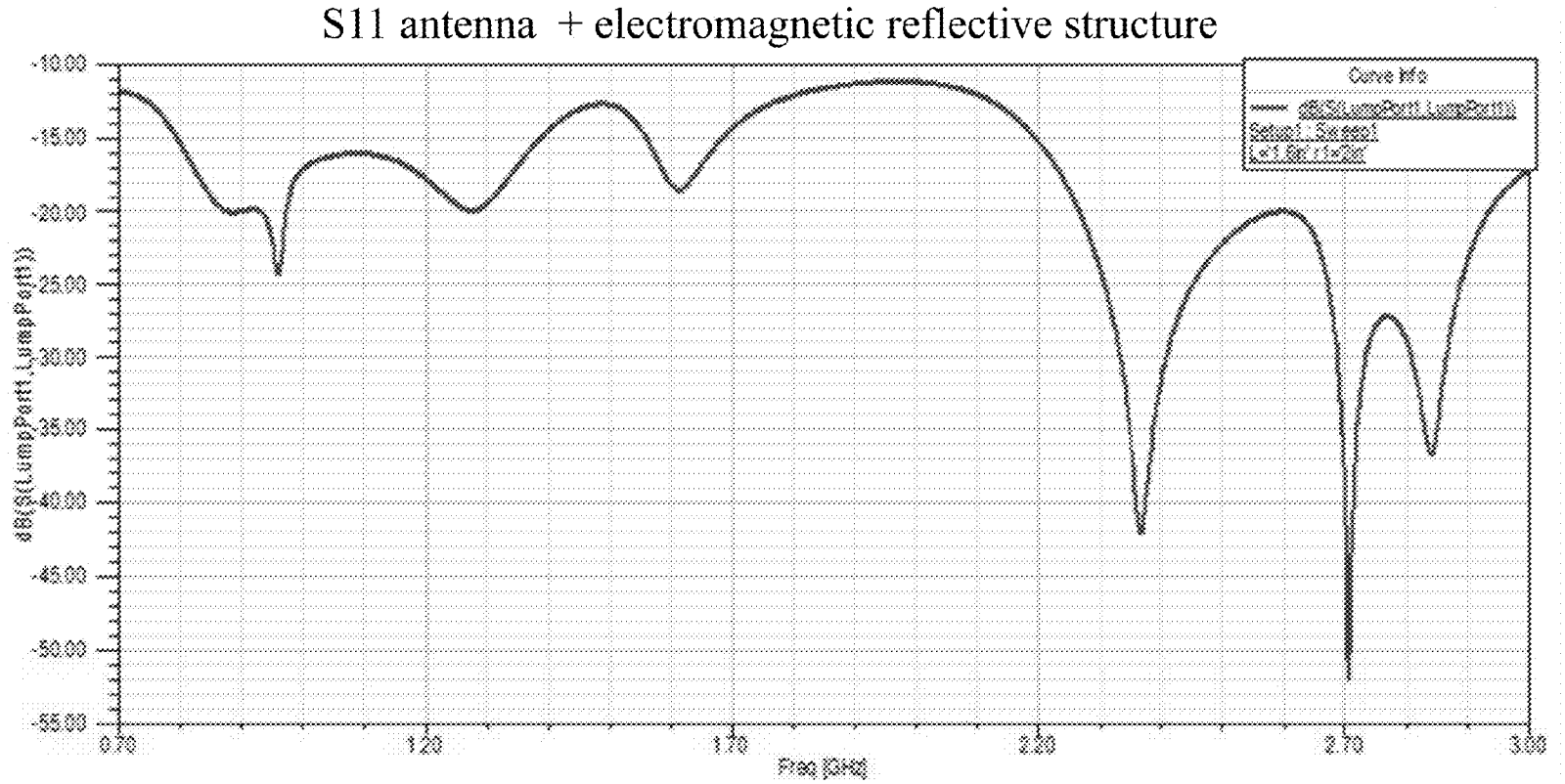
FIG. 13 is an illustration showing computed S11 for an antenna with an electromagnetic reflective structure.

An electromagnetic reflective structure was placed 5.08 cm below the antenna in simulation, and their computed performance is displayed in FIG. 13 and FIG. 14, return loss and realized gain, respectively. The return loss is below −10 dB for the entire frequency band of 700 MHz-3000 MHz. FIG. 12 is a plot showing S11 of an antenna with a director. Beyond the third marker is a −10 dB in return loss, starting at approximately 1.2 GHz.

The electromagnetic reflective structure is placed such that electromagnetic reflective structure 30 effects and ground reflection effects are combined. Improvement of gain from 700 MHz to about 2 GHz is attributable to electromagnetic reflective structure 30 and improvement above 2 GHz is credited to ground plane reflection since it is placed a quarter-wave length behind an antenna at 2 GHz, see FIG. 14. However, it appears that phase canceling of the two components occurs around 2.2 GHz, resulting in reduction of gain around that frequency.

Figure 15:
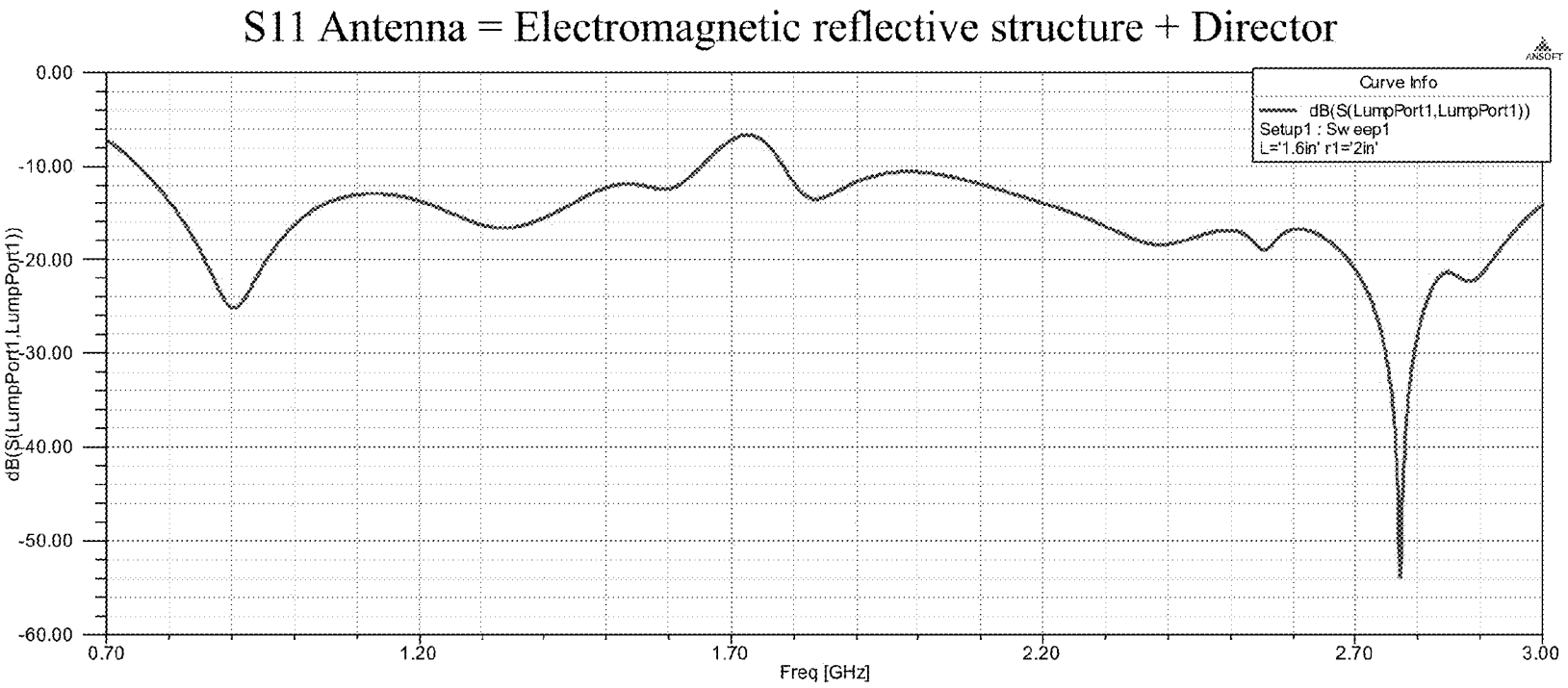
FIG. 15 is an illustration showing return loss plot of an ultra-wideband antenna with a director and the electromagnetic reflective structure.

Following the analogy of the Yagi-Uda array, to reduce the radiation to the back-side of the monopole and increase its gain, a reflective layer can be added at the side of the monopole that is opposite to the director side. A conducting ground plane can function as such reflector, but it has to be placed a quarter-wavelength under the monopole in order to produce the right reflection phase. This narrow-band solution also has the disadvantage of increasing the dimension of the antenna in the direction perpendicular to the monopole plane. An alternative to the conducting-plane reflector is the addition of an electromagnetic reflective structure, which is designed to operate over a wide band, and because of its reflection phase characteristics, it can be placed close to the monopole plane, which reduces the overall size of the antenna assembly. A return loss plot of the monopole-plus-director over an electromagnetic reflective surface is shown in FIG. 15.

The electromagnetic reflective structure 30 and the director 10 described above are added to the antenna in simulation. As can be seen in FIG. 16, the three combinations provide better performance than that of other combinations exhibited, especially above 1.6 GHz. FIG. 16 shows the realized gain plot of an ultra-wideband antenna with an electromagnetic reflector structure and a director, the line with x tick marks. It is overlaid with other combinations described previously. The line with diamond tick marks is antenna only, the line with triangle tick marks is antenna with a director, and the line with square tick marks is antenna with electromagnetic reflective structure. The effect of adding the electromagnetic reflector surface on the gain of the director-enhanced monopole antenna is shown in FIG.16. FIG. 16 shows that the combination of a director element in front of the monopole and an electromagnetic reflector structure behind it produce the predicted Yagi-Uda effect of high directive gain across the wide frequency band.

The preferred embodiment uses somewhat thin dielectric materials, 0.0254 cm and 0.157 cm, and very lightweight form to minimize its weight and extremely thin copper sheet, less than $2.54\times10^{-4}$ cm.

Known and possible uses of invention include use as an ultra-wideband antenna and also in many single, dual, triple or more simultaneous frequency operations. In addition, the antenna can be scaled to adjust to a particular frequency band of interest.

Figure 14:
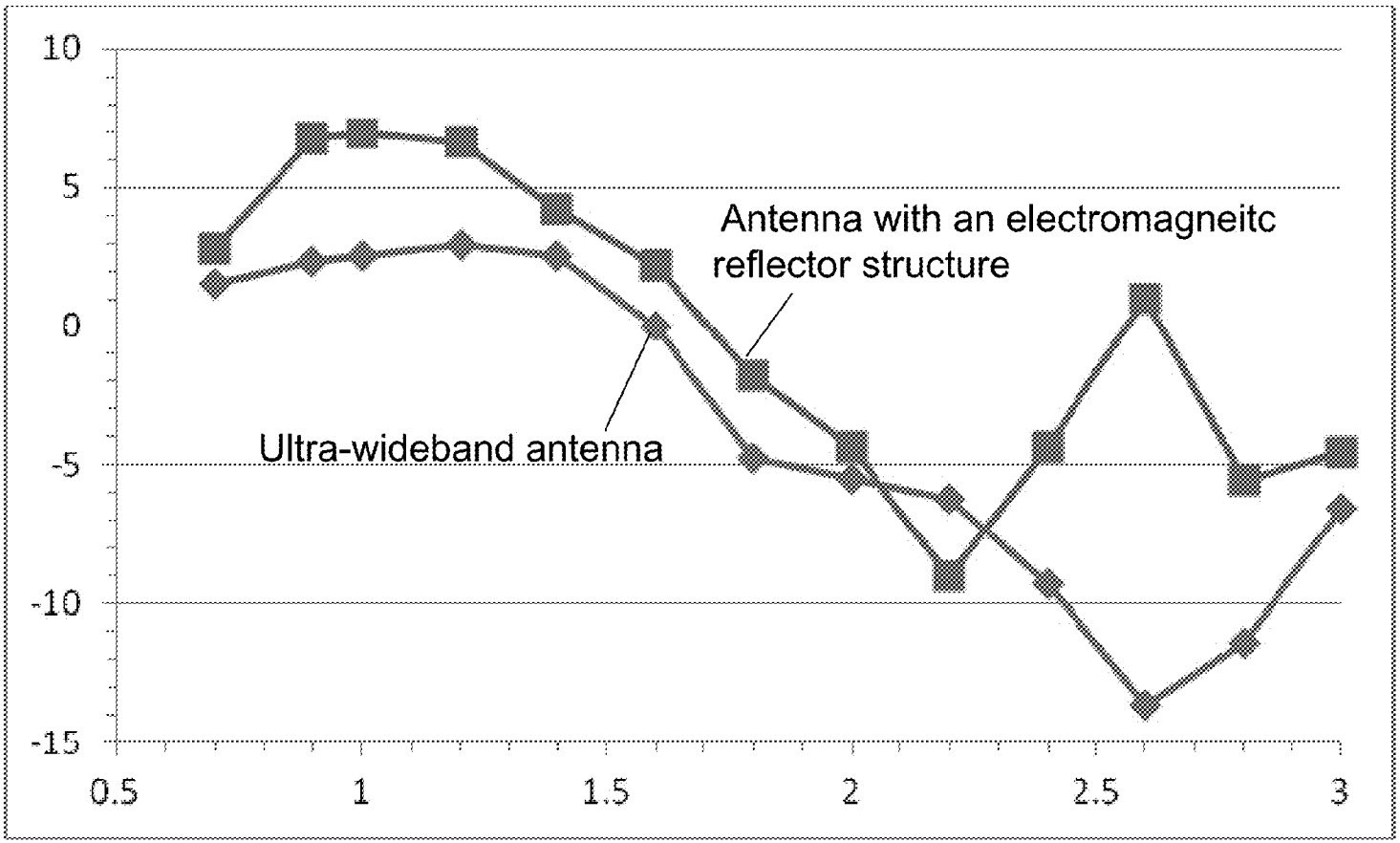
FIG. 14 is an illustration in which realized gain is plotted, the line with square tick marks, for an antenna with an electromagnetic reflective structure. The other line is the realized gain of the basic ultra-wideband monopole antenna

Referring to FIG. 14, improvement of gain from 700 MHz to about 2 GHz is attributable to electromagnetic reflective structure and improvement of gain above 2 GHz is credited to ground plane reflection, a quarter-wave length behind an antenna. It appears that phase canceling of the two components occurs around 2.2 GHz, resulting in reduction of gain around that frequency. This is compensated for by using the director in front of the antenna.

The present invention relates to ultra-wideband antenna with a director and an electromagnetic reflective structure 30, 300, 300A. The present invention consists of an ultra-wideband antenna, a director, and an electromagnetic reflective structure 30, 300, 300A optimally placed to work together to provide optimal gain and good return loss. The combinations of the three elements provide excellent gain over a very wide frequency band. Previous applications of the electromagnetic reflective structure have been limited to very narrow band antenna applications since the electromagnetic reflective structure was known to work in a very narrow band. However, it was demonstrated that by placing the electromagnetic reflective structure below and away from the antenna and using the director above the antenna, as shown in this invention disclosure, the electromagnetic reflective structure 30 works over more than an octave frequency band. A further increase in the electromagnetic reflective structure bandwidth can be obtained by using multiple-resonance structures.

As used herein the terminology "electromagnetic reflective structure" refers to a structure or subassembly which reflects electromagnetic radiation.

As used herein the terminology "electromagnetic reflective subassembly" refers to a structure which reflects electromagnetic radiation.

As used herein the terminology "substantially optimal magnetic conductor" means a conductor having nearly perfect magnetic conductance.

As used herein, the terminology "resonance" relates to electromagnetic resonance and relates to the tendency of a system or structure to oscillate with greater amplitude at some frequencies than at others. Resonant or resonance frequencies occur when the response amplitude is a relative maximum.

As used here in a cavity resonator is a hollow conductor blocked at both ends and along which an electromagnetic wave can be supported, similar in nature to a waveguide short-circuited at both ends. The cavity's interior surfaces reflect a wave of a specific frequency. When a wave that is resonant with the cavity enters, it bounces back and forth within the cavity, with low loss (forming a standing wave). As more wave energy enters the cavity, it combines with and reinforces the standing wave, increasing its intensity.

As used herein the word "size" is not limited to a measure of physical characteristics, but also includes a measure of electrical characteristics.

As used herein the terminology "incident" radiation refers to the radiation hitting a specific surface.

As used herein the terminology "stacked" means an orderly pile, such as, for example, one arranged in layers.

As used herein the terminology "UWB" or ultra wide frequency band" means a transmission from an antenna for which the emitted signal bandwidth exceeds the lesser of 500 MHz or 20% of the center frequency.

The foregoing description of the specific embodiments are intended to reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Obviously, many modifications and variations of the present invention are possible in light of the above teachings. It is therefore to be understood that, within the scope of the appended claims, the invention many be practiced otherwise than as specifically described.

What is claimed is:

1. An ultra-wideband antenna assembly comprising:

an electromagnetic reflective structure for reflecting electromagnetic waves over an ultrawide bandwidth: the electromagnetic reflective structure configured to to reflect electromagnetic waves in a first direction and comprising first, second and third groups of differently sized patches configured to resonate at different closely spaced frequency bands, thereby providing an ultra-wide band operation:

a printed circular monopole antenna supported by a dielectric substrate and further comprising an electrically conductive coplanar waveguide designed for the 700-3000 MHz band in electrical communication with the antenna, the electrically conductive coplanar waveguide comprising two ground planes supported by the dielectric substrate;

the printed circular monopole antenna being operatively associated with the electromagnetic reflective structure such that electromagnetic waves emitted from the printed circular monopole antenna towards the electromagnetic wave reflective structure are reflected back by the electromagnetic reflective structure in the first direction: the antenna being substantially planar and extending in a first plane: the first direction being substantially perpendicular to the first plane: and at least one director operatively associated with the antenna for focusing the electromagnetic waves transmitted by the antenna in the first direction: the at least one director being substantially planar and extending in a second plane wherein the second plane is substantially parallel to the first plane.

2. The assembly of claim 1 the dielectric substrate comprising one of fiberglass reinforced epoxy laminate (FR-4), polytetrafluoroethylene (PTFE) composites reinforced with glass microfibers, and ceramic, and wherein the dielectric substrate is rectilinear in shape.

3. An ultra-wideband antenna assembly comprising:

an electromagnetic reflective structure for reflecting electromagnetic waves over an ultrawide bandwidth; the electromagnetic reflective structure configured to to reflect electromagnetic waves in a first direction and comprising first, second and third groups of differently sized patches configured to resonate at different closely spaced frequency bands, thereby providing an ultra-wide band operation:

a dielectric:

a circular monopole antenna mounted to a first surface of the dielectric and operatively associated with the electromagnetic reflective structure such that electromagnetic waves emitted from the antenna towards the electromagnetic wave reflective structure are reflected back by the electromagnetic reflective structure in the first direction: the antenna being substantially planar and extending in a first plane: the first direction being substantially perpendicular to the first plane: and an electrically conductive coplanar waveguide configured to feed the antenna mounted to the first surface of the dielectric substrate, the electrically conductive coplanar waveguide being designed for the 700-3000 MHz band;

a plurality of planar directors operatively associated with the antenna for focusing the electromagnetic waves transmitted by the antenna in the first direction: each of the plurality of directors being substantially planar and extending in a second plane wherein the second plane is substantially parallel to the first plane: each of the planes being spaced form one another.

4. The assembly of claim 3 wherein the first, second and third groups are stacked layers, each layer configured to resonate at a different frequency leading to a plurality of resonances at different frequencies resulting in the ultra-wide band operation and wherein the plurality of resonances are a function of the spacing between the patches and the size of the patches.

5. The assembly of claim 3 wherein resonance is created within cavities defined between the first, second and third groups.

6. The structure of claim 3 wherein the first, second and third groups are substantially planar and are substantially parallel to one another and wherein the electromagnetic waves are reflected in the first direction, away from the first group.

7. The structure of claim 3 wherein the first, second and third groups are separated by at least one dielectric material comprising one of ceramic, foam and plastic, and wherein the spacing between the first, second and third groups forms resonant cavities.

8. An ultra-wideband antenna assembly comprising:

an electromagnetic reflective subassembly for reflecting electromagnetic waves; the electromagnetic reflective subassembly comprising a first layer, a second layer, and a third layer; each layer being in the stacked arrangement configured to reflect electromagnetic waves in a first direction;

a dielectric substrate;

a circular monopole antenna mounted to a first surface of the dielectric and operatively associated with the electromagnetic reflective subassembly such that electromagnetic waves emitted from the antenna towards the electromagnetic reflective subassembly are reflected back by each layer of the electromagnetic reflective subassembly in the first direction; the antenna being substantially planar and extending in a first plane; the first direction being substantially perpendicular to the first plane;

an electrically conductive coplanar waveguide mounted to the first surface of the dielectric substrate; the electrically conductive coplanar waveguide configured to feed the antenna and being designed for the 700-3000 MHz band;

at least one director operatively associated with the antenna for focusing the electromagnetic waves transmitted by the antenna in the first direction; the at least one director being substantially planar and extending in a second plane wherein the second plane is substantially parallel to the first plane;

the first layer comprising a first plurality of spaced apart patches of conductive material extending in a third plane substantially parallel to the first and second planes; the first plurality of spaced apart patches configured to reflect the electromagnetic waves in a first frequency range: a second layer substantially parallel to and separated from the first layer, the second layer being substantially planar and comprising a second plurality of spaced apart patches of conductive material configured to reflect the electromagnetic waves in a second frequency range: a third layer substantially parallel to and separated from the first and second layers the third layer being substantially planar and comprising a third plurality of spaced apart patches of conductive material configured to reflect the electromagnetic waves in a third frequency range: wherein the first, second and third plurality of spaced apart patches have different sizes so as to produce a resonate condition at the first, second and third frequency ranges; the first, second and third frequency ranges being additive and being substantially close to one another such that the reflective subassembly reflects electromagnetic waves in an ultra wide frequency band; and the electromagnetic reflective subassembly configured to reflect electromagnetic waves originating from the antenna, the electromagnetic waves being reflected by the electromagnetic reflective subassembly being such that the phase of the electromagnetic waves reflected from the electromagnetic reflective subassembly results in the constructive addition of the originating and reflected waves, thus enhancing the radiation of electromagnetic waves by the antenna.

9. A method of making an ultra-wideband antenna comprising:

providing an electromagnetic reflective structure having three layers for reflecting electromagnetic radiation; the electromagnetic reflective structure configured to reflect waves in a first direction; the dimensions of the electromagnetic reflective structure being selected such that the bottom layer resonates at 0.6 GHz, the middle layer resonates at 0.9 GHz, and the top layer resonates at 1.1 GHz;

providing a circular monopole antenna element adhered to a first frontal surface of a dielectric substrate operatively associated with the electromagnetic reflective structure such that waves emitted from the antenna element emitted towards the electromagnetic reflective structure are reflected back by the electromagnetic reflective structure towards the antenna element; the antenna element being substantially planar and extending in a substantially in a first plane;

providing at least one director operatively associated with the antenna element for focusing the electromagnetic waves transmitted by the antenna element; the at least one director being substantially planar and extending in a second plane wherein the second plane is substantially parallel to the first plane; and providing an electrically conductive coplanar waveguide adhered to the same first frontal surface of the dielectric substrate to feed the antenna element, the electrically conductive coplanar waveguide being designed for the 700-3000 MHz band and comprising two ground planes.

* * * * *